US007878853B2

(12) United States Patent
Amleshi et al.

(10) Patent No.: US 7,878,853 B2
(45) **Date of Patent: *Feb. 1, 2011**

(54) HIGH SPEED CONNECTOR WITH SPOKED MOUNTING FRAME

(75) Inventors: Peerouz Amleshi, Lisle, IL (US); John Laurx, Aurora, IL (US)

(73) Assignee: Molex Incorporated, Lisle, IL (US)

( * ) Notice: Subject to any disclaimer, the term of this patent is extended or adjusted under 35 U.S.C. 154(b) by 172 days.

This patent is subject to a terminal disclaimer.

(21) Appl. No.: 12/214,644

(22) Filed: Jun. 20, 2008

(65) Prior Publication Data

US 2009/0011644 A1 Jan. 8, 2009

Related U.S. Application Data

(60) Provisional application No. 60/936,385, filed on Jun. 20, 2007.

(51) Int. Cl.
*H01R 13/648* (2006.01)

(52) U.S. Cl. ..... 439/607.08; 439/607.11

(58) Field of Classification Search ..... 439/607.1, 439/607.03, 607.11, 941
See application file for complete search history.

(56) References Cited

U.S. PATENT DOCUMENTS

| | | | |
|---|---|---|---|
| 4,733,172 | A | 3/1988 | Smolley |
| 4,973,273 | A | 11/1990 | DePriest |
| 5,019,945 | A | 5/1991 | Smolley |
| 5,795,191 | A | 8/1998 | Preputnick et al. |
| 6,146,202 | A | 11/2000 | Ramey et al. |
| 6,146,207 | A | 11/2000 | Mulot |
| 6,328,602 | B1 | 12/2001 | Yamasaki et al. |
| 6,350,134 | B1 | 2/2002 | Fogg et al. |
| 6,379,188 | B1 | 4/2002 | Cohen et al. |
| 6,471,548 | B2 | 10/2002 | Bertoncini et al. |
| 6,540,559 | B1 | 4/2003 | Kemmick et al. |
| 6,652,318 | B1 | 11/2003 | Winings et al. |
| 6,692,272 | B2 | 2/2004 | Lemke et al. |
| 6,743,057 | B2 | 6/2004 | Davis et al. |
| 6,808,419 | B1 | 10/2004 | Korsunsky et al. |
| 6,827,611 | B1 | 12/2004 | Payne et al. |

(Continued)

FOREIGN PATENT DOCUMENTS

| | | |
|---|---|---|
| EP | 0924812 | 6/1999 |

(Continued)

OTHER PUBLICATIONS

International Search Report for PCT/US08/007750.

*Primary Examiner*—Hien Vu
(74) *Attorney, Agent, or Firm*—Stephen L. Sheldon

(57) ABSTRACT

A high speed connector with reduced crosstalk utilizes individual connector support frames that are assembled together to form a block of connector units. Each such unit supports a column of conductive terminals in two spaced-apart columns. The columns have differential signal terminal pairs separated from each other by larger intervening ground shields that serve as ground terminals. The ground shields are arranged in alternating fashion within the pair of columns and they are closely spaced together so as to face a differential signal terminal pair. The support frames support the ground and signal terminals utilizing radial spokes in which the spokes take the form of ribs that extend along the inner surfaces of one of the connector halves and define V-shaped air channels.

9 Claims, 24 Drawing Sheets

U.S. PATENT DOCUMENTS

| | | | | |
|---|---|---|---|---|
| 6,843,687 | B2 | 1/2005 | McGowan et al. | |
| 6,863,543 | B2 | 3/2005 | Lang et al. | |
| 7,131,870 | B2 | 11/2006 | Whiteman et al. | |
| 7,163,421 | B1 | 1/2007 | Cohen et al. | |
| 7,195,497 | B2 | 3/2007 | Hull et al. | |
| 7,267,515 | B2 | 9/2007 | Lappohn | |
| 7,322,856 | B2 * | 1/2008 | Laurx et al. | 439/607.1 |
| 7,332,856 | B2 | 2/2008 | Kijima et al. | |
| 7,338,321 | B2 | 3/2008 | Laurx | |
| 7,384,311 | B2 | 6/2008 | Sharf et al. | |
| 7,458,839 | B2 | 12/2008 | Ngo et al. | |
| 7,473,138 | B2 | 1/2009 | Tuin et al. | |
| 7,553,190 | B2 | 6/2009 | Laurx et al. | |
| 7,591,655 | B2 | 9/2009 | Fedder et al. | |
| 2001/0010979 | A1 | 8/2001 | Ortega et al. | |
| 2003/0171010 | A1 | 9/2003 | Winings et al. | |
| 2004/0043648 | A1 | 3/2004 | Houtz | |
| 2004/0097112 | A1 | 5/2004 | Minich et al. | |
| 2006/0172570 | A1 | 8/2006 | Minich | |
| 2007/0021001 | A1 | 1/2007 | Laurx et al. | |
| 2007/0021003 | A1 | 1/2007 | Laurx et al. | |
| 2007/0021004 | A1 | 1/2007 | Laurx et al. | |
| 2007/0049118 | A1 * | 3/2007 | Reeser et al. | 439/608 |
| 2007/0059952 | A1 | 3/2007 | Raistrick et al. | |
| 2009/0011642 | A1 | 1/2009 | Amleshi et al. | |
| 2009/0011643 | A1 | 1/2009 | Amleshi et al. | |
| 2009/0011645 | A1 | 1/2009 | Laurx et al. | |
| 2009/0011655 | A1 | 1/2009 | Amleshi et al. | |
| 2009/0011664 | A1 | 1/2009 | Laurx et al. | |
| 2009/0017681 | A1 | 1/2009 | Amleshi et al. | |
| 2009/0017682 | A1 | 1/2009 | Amleshi et al. | |
| 2009/0071682 | A1 | 3/2009 | Crawford | |

FOREIGN PATENT DOCUMENTS

| | | | |
|---|---|---|---|
| EP | 1 732 176 | A1 | 12/2006 |
| WO | WO 86/01644 | | 3/1986 |
| WO | WO 01/57964 | | 8/2001 |
| WO | WO 2007/058756 | A1 | 5/2007 |
| WO | WO 2007/076900 | | 7/2007 |
| WO | WO 2008/002376 | | 1/2008 |
| WO | WO 2008/156856 | | 12/2008 |

* cited by examiner

FIG.11A

Cross Talk Pin Map Example

| | 1 | 2 | 3 | 4 | 5 | 6 | 7 | 8 | 9 | 10 |
|---|---|---|---|---|---|---|---|---|---|---|
| A | G | S | G | S | G | S | G | S | G | S |
| B | S | S | S | S | S | S | S | S | S | S |
| C | S | G | S | G | S | G | S | G | S | G |
| D | G | S | G | S | G | S | G | S | G | S |
| E | S | S | S | S | S | S | S | S | S | S |
| F | S | G | S | G | S | G | S | G | S | G |
| G | G | S | G | S | G | S | G | S | G | S |
| H | S | S | S | S | S | S | S | S | S% | S |
| J | S | G | S | G | S | G | S | G | S% | G |
| K | G | S | G | S | G | S | G | S% | G | S* |
| L | S | S | S | S | S | S | S | S% | S | S* |
| M | S | G | S | G | S | G | S | G | S | G |
| N | G | S | G | S | G | S | G | S* | G | S% |
| O | S | S | S | S | S | S | S | S* | S% | S% |
| P | S | G | S | G | S | G | S | G | S% | G |

G Ground

S S Victim

S% S% Aggressor Measured

S* S* Aggressor

Worst Case Crosstalk for Victim Pair L9M9

| | $T_{rise}$ = 33ps (20–80%) | |
|---|---|---|
| | %NEXT | %FEXT |
| Aggressors | | |
| H9J9 | 0.38 | 0.28 |
| 09P9 | 0.33 | 0.45 |
| K8L8 | 0.40 | 0.20 |
| N10010 | 0.68 | 0.23 |
| N808 | 0.68 | 0.23 |
| K10L10 | 0.40 | 0.20 |
| Total | %2.87 | %1.59 |

HIGH SPEED CONNECTOR WITH SPOKED MOUNTING FRAME

REFERENCE TO RELATED APPLICATIONS

This application claims priority of U.S. Provisional Patent Application No. 60/936,385, filed Jun. 20, 2007.

BACKGROUND OF THE INVENTION

The present invention relates generally to high speed connectors, and more particularly to high speed backplane connectors, with reduced crosstalk and improved performance.

High speed connectors are used in many data transmission applications particularly in the telecommunications industry. Signal integrity is an important concern in the area of high speed and data transmission for components need to reliably transmit data signals. The high speed data transmission market has also been driving toward reduced size components.

High speed data transmission is utilized in telecommunications to transmit data received from a data storage reservoir or a component transmitter and such transmission most commonly occurs in routers and servers. As the trend of the industry drives toward reduced size, the signal terminals in high speed connectors must be reduced in size and to accomplish any significant reduction in size, the terminals of the connectors must be spaced closer together. As signal terminal are positioned closer together, signal interference occurs between closely spaced signal terminals especially between pairs of adjacent differential signal terminals. This is referred to in the art as "crosstalk" and it occurs when the electrical fields of signal terminals abut each other and intermix. At high speeds the signal of one differential signal pair may drift and cross over to an adjacent or nearby differential signal pair. This affects signal integrity of the entire signal transmission system. The reduction of crosstalk in high speed data systems is a key goal in the design of high speed connectors.

Previously, reduction of crosstalk was accomplished primarily by the use of shields positioned between adjacent sets of differential signal terminals. These shields were relatively large metal plates that act as an electrical reference point, or barrier, between rows or columns of differential signal terminals. These shields add significant cost to the connector and also increase the size of the connector. The shields may act as large capacitive plates to increase the coupling of the connector and thereby lower the impedance of the connector system. If the impedance is lowered because of the shields, care must be taken to ensure that it does not exceed or fall below a desired value at that location in the connector system. The use of shields to reduce crosstalk in a connector system requires the system designer to take into account their effect on impedance and their effect on the size of the connector.

Some have tried to eliminate the use of shields and rely upon individual ground terminals that are identical in shape and dimension to that of the differential signal terminals with which they are associated. However, the use of ground terminals the same size as the signal terminals leads to problems in coupling which may drive up the system impedance. The use of ground terminals similarly sized to that of the signal terminals requires careful consideration to spacing of all the terminals of the connector system throughout the length of the terminals. In the mating interface of high speed connector, impedance and crosstalk may be controlled due to the large amounts of metal that both sets of contacts present. It becomes difficult to match the impedance within the body of the connector and along the body portions of the terminals in that the terminal body portions have different configurations and spacing than do the contact portions of the terminals. This difficulty increases in areas of the connector where the terminals are mounted to their insulative support frames or housings. Adding more connector housing support material, such as plastic, may reduce the amount of air to be used as a dielectric, which may promote an impedance discontinuity so that due consideration must be made with respect to the manner in which the terminals are mounted in the connector.

The present invention is therefore directed to a high speed connector that overcomes the above-mentioned disadvantages and which uses ground terminals in the form of a plurality individual shields, which are associated with each differential signal terminal pair to control crosstalk, and in which the connector housing, or frame, has a structure that assists in controlling the impedance of the terminals in their extent through the connector frame.

SUMMARY OF THE INVENTION

It is therefore a general object of the present invention to provide an improved connector for high speed data transmission which has reduced crosstalk.

Another object of the present invention is to provide a high speed connector for backplane applications in which a plurality of discrete pair of differential signal terminals are arranged in pairs within columns of terminals, each differential signal pair being flanked by an associated ground shielded terminal in an adjacent column, the ground shield terminal having dimensions greater than that of one of the differential signal terminals so as to provide a large reference ground in close proximity to the differential signal pair so as to permit the differential signal pair to broadside couple to the individual ground shield facing it.

Yet a further object of the present invention is to provide a connector of the type described above where the ground shields in each pair of columns within each connector unit trace a serpentine path through the body portion of the connector unit from the top of the connector unit to the bottom thereof.

A still further object of the present invention is to provide a high speed connector that utilizes a series of terminal assemblies supported within connector wafers, each connector wafer supporting a pair of columns of conductive terminals, the terminals being arranged in pairs of differential signal terminals within the column and flanked by larger ground shield terminals in the body of the connector, the ground shields being alternatively arranged in the column so that each differential signal pair in one column has a ground shield facing it in the other column and a ground shield adjacent to it within the column so that the two differential signal terminals are edge coupled to each other within the column and are broadside coupled to a ground shield in an adjacent column.

Yet a still further object of the present invention is to provide a high speed connector for use in backplane applications in which conductive terminals are supported as a pair of columns of terminals within two connector halves, each connector half including a support frame, each support frame including a series of radial ribs, or spokes, which support the terminals, one of the radial ribs in each connector half bisecting the connector half, the ribs being formed over the terminals in one of the two connector halves and projecting outwardly into contact with the terminals in the other of the two connector halves, thereby defining at least one V-shaped air passage within the support frame and between the two connector halves.

Another object of the present invention is to provide a connector with the spoked structure as stated above wherein portions of the support frame are molded over the terminals to hold them in place, and where the ground shield terminal s include windows portions formed in their body portions in locations where the ground shield terminals intersect with a radial rib, and the signal terminals are narrowed where they oppose the ground shield terminal windows, so as to increase their edge-to-edge spacing and maintain a desired coupling level between the signal terminal pair through the mounting area.

The present invention accomplishes these and other objects by virtue of its unique structure. In one principal aspect, the present invention encompasses a backplane connector that utilizes a header connector intended for mounting on a backplane and a right angle connector intended for mounting on a daughter card. When the two connectors are joined together, the backplane and the daughter card are joined together, typically at a right angle.

The right angle connector, which also may be referred to as a daughter card connector, is formed from a series of like connector units. Each connector unit has an insulative frame formed, typically molded from a plastic or other dielectric material. This frame supports a plurality of individual connector units, each supporting an array conductive terminals. Each connector unit frame has at least two distinct and adjacent sides, one of which supports terminal tail portions and the other of which supports the terminal contact portions of the terminal array. Within the body of the daughter card connector, the frame supports the terminals in a columnar arrangement, or array so that each unit supports a pair of terminal columns therein.

Within each column, the terminals are arranged so as to present isolated differential signal pairs. In each column, the differential signal terminal pairs are arranged edge to edge in order to promote edge (differential mode) coupling between the differential signal terminal pairs. The larger ground shield terminals are first located in an adjacent column directly opposite the differential signal terminal pair and are secondly located in the column adjacent (above and below) the differential signal terminal pairs. In this manner, the terminals of each differential signal terminal pair edge couple with each other but also engage in broadside (common mode) coupling to the ground shield terminals facing the differential signal terminal pairs. Some edge coupling, which is also common mode coupling, occurs between the differential signal terminal pairs and the adjacent in the ground shield terminals. The larger ground shield terminals, in the connector body, may be considered as arranged in a series of inverted V-shapes, which are formed by interconnecting groups of three ground shield terminals by imaginary lines and a differential signal terminal pair is nested within each of these V-shapes.

The frame is an open frame that acts as a skeleton or network, that holds the columns of terminals in their preferred alignment and spacing. In this regard, the frame includes at least intersecting vertical and horizontal parts and at least one bisector that extends out from the intersection to divide the area between the vertical and horizontal members into two parts. The bisector takes the form of a radial rib in the preferred embodiment, and two other radial spokes subdivide the two parts, so as to form distinct open areas on the outer surface of each of the connector unit wafer halves. This network of radial spokes, along with the base vertical and horizontal members, supports a series of ribs that provide a mechanical backing for the larger ground shield terminals. The spokes are also preferably arranged so that they serve as a means for transferring the press-in load that occurs on the top of the daughter card connector to the compliant pin tail portions during assembly of the daughter card connector to the daughter card.

The radial spokes are continued on the interior surface of one of the connector unit wafer halves and serves as standoffs to separate the columns of terminals when the two connector unit wafer halves are joined together so that an air spacing is present between the columns of terminals. The signal and larger ground shield terminals make at least two bends in their extent through the connector body and in these bend areas, the impedance of the connector units is controlled by reducing the amount of metal present in both the differential signal terminal pair and in their associated ground shield terminals. This reduction is accomplished in the ground shield terminals by forming a large window and in the signal terminal by "necking" or narrowing the signal terminal body portions down in order to increase the distance between the signal terminal edges.

The necked down portions of the differential signal terminal pairs are also aligned with the support spokes of the connector unit support frame and the ground shield terminal windows. In this manner, broadside coupling of the differential signal terminal is diminished with the ground shield terminals at this area. The connector unit wafer halves may further include secondary radials spokes in addition to the primary spoke that serves as the bisector of the frame. These secondary spokes preferably extend along radial lines of action, but for a shortened length as compared to the bisector spoke. In so doing, they serve to define one or more V-shaped air passages between the two terminal columns of the connector.

A transition is provided where the terminal tail portions meet the terminal body portions, so as to create a uniform mounting field of the terminal tail portions. In this regard, the tail ends of terminal body portions extend outwardly from their location adjoining the centerline of the connector unit, and toward the sides of the connector units so as to achieve a desired, increased width between the terminal tail portions of the two columns so that the tail portions are at a certain pitch, widthwise between columns. In order to achieve a desired depth between the terminal tail portions within each column, the ends of the terminal body portion near the terminal tail portions shift in the lateral direction along the bottom of the connector unit support frame, so that the tail portions are arranged in a uniform spacing, rather than in an uneven spacing were the tail portions to be centered with the ends of the terminal body portions.

These and other objects, features and advantages of the present invention will be clearly understood through a consideration of the following detailed description.

BRIEF DESCRIPTION OF THE DRAWINGS

In the course of this detailed description, reference will be frequently made to the attached drawings in which:

FIG. 11A is a crosstalk pin map of the connector of FIG. 1, identifying the rows and columns of terminals by alpha and numerical designations, respectively and identifying actual crosstalk obtained from testing of a connector of the present invention;

DETAILED DESCRIPTION OF THE PREFERRED EMBODIMENTS

Figure 1:
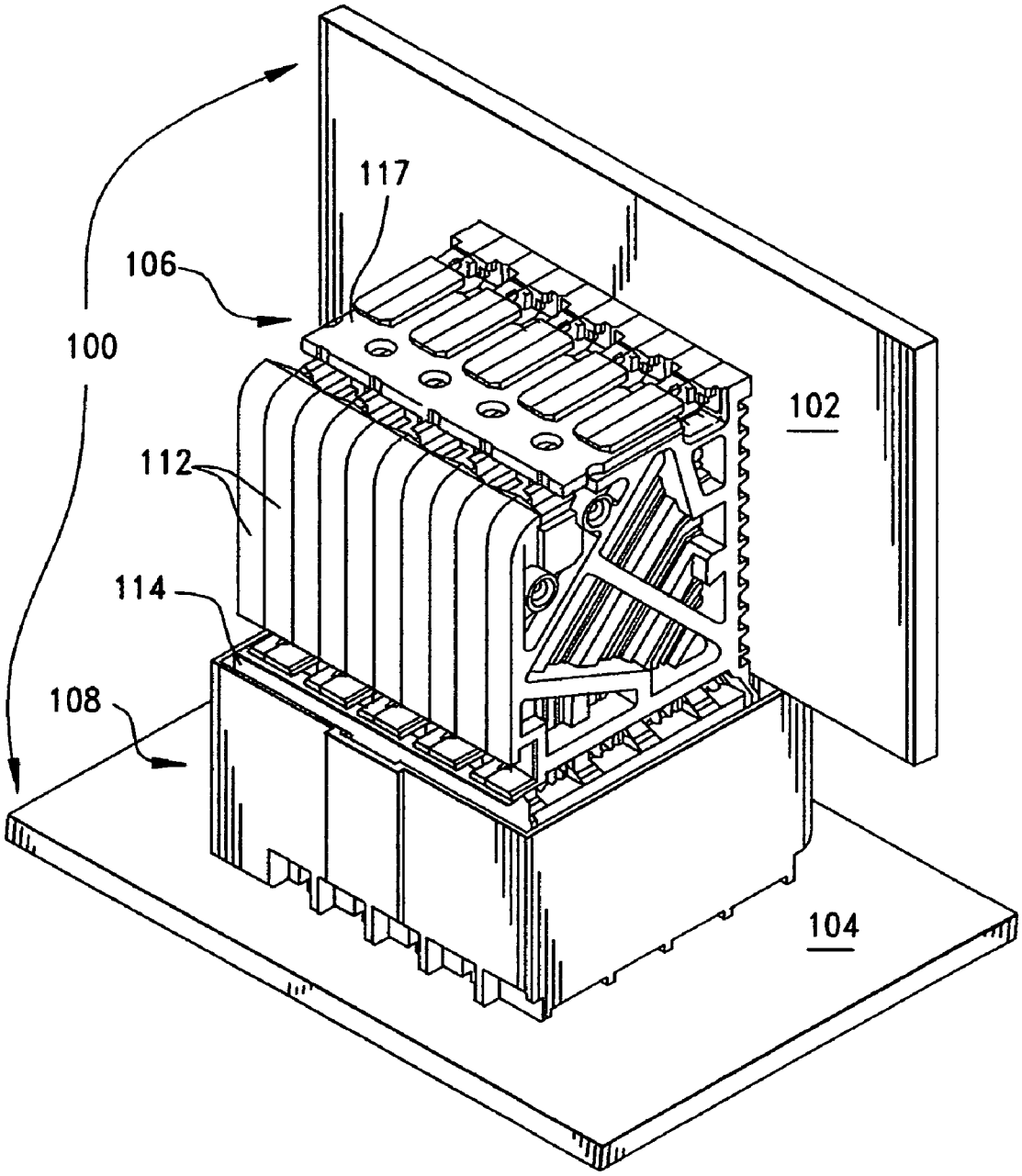
FIG. 1 is a perspective view of a backplane connector assembly constructed in accordance with the principles of the present invention in which a daughter card connector mates with a pin header to interconnect two circuit boards together.
Figure 2:
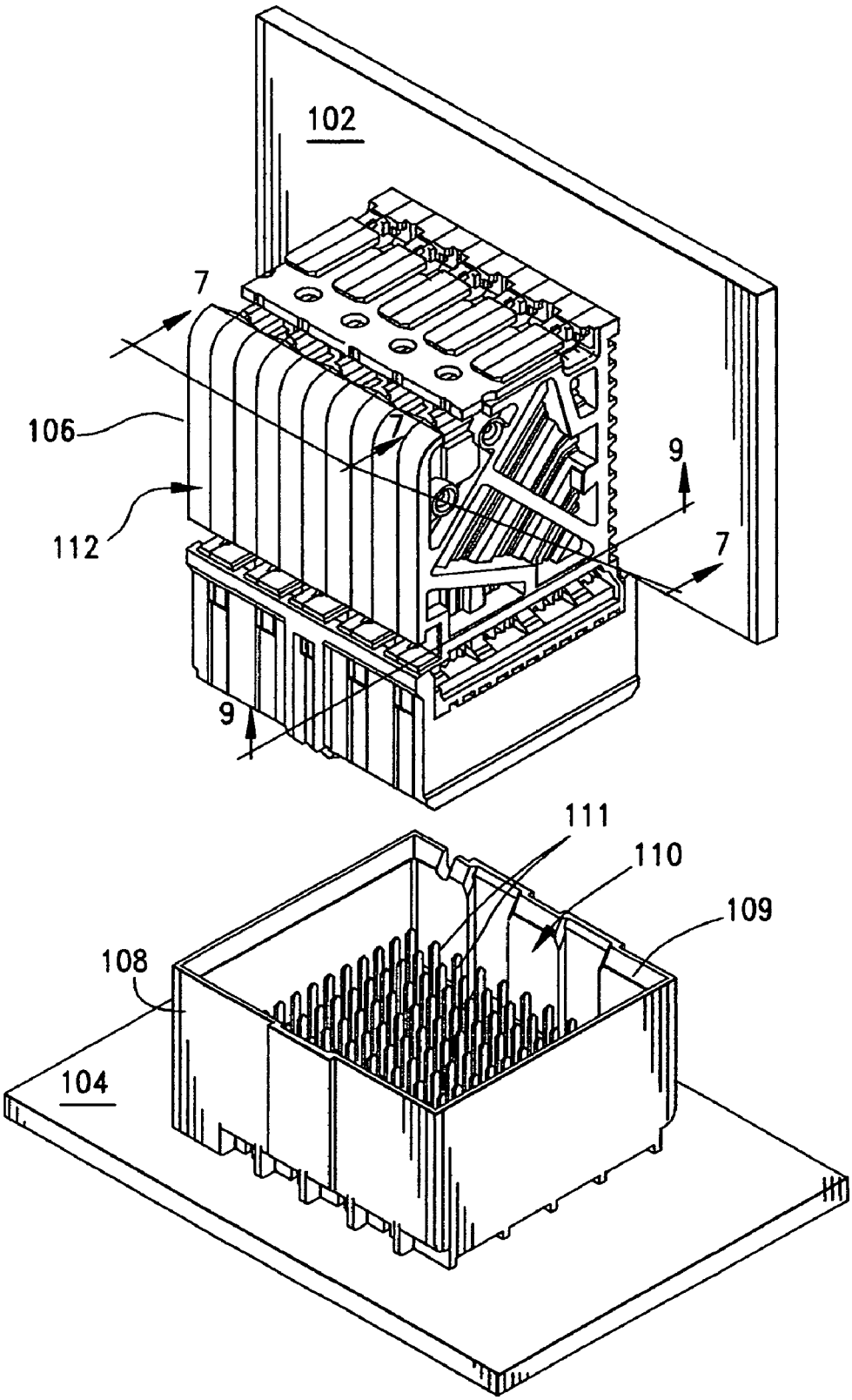
FIG. 2 is the same view as FIG. 1, but illustrating the daughter card connector removed from the backplane pin header.

FIG. 1 illustrates a backplane connector assembly 100 that is constructed in accordance with the principles of the present invention and which is used to join an auxiliary circuit board 102, known in the art as a daughter card, to another circuit board 104, typically referred to in the art as a backplane. The assembly 100 includes two connectors 106 and 108. As shown best in FIG. 2, the backplane connector 108 takes the form of a pin header having four sidewalls 109 that cooperatively define a hollow receptacle 110. A plurality of conductive terminals in the form of pins 111 are provided and held in corresponding terminal-receiving cavities of the connector 108 (not shown). The pins 111 are terminated, such as by tail portions to conductive traces on the backplane 104 and these tail portions fit into plated vias, or through holes disposed in the backplane.

Figure 3:
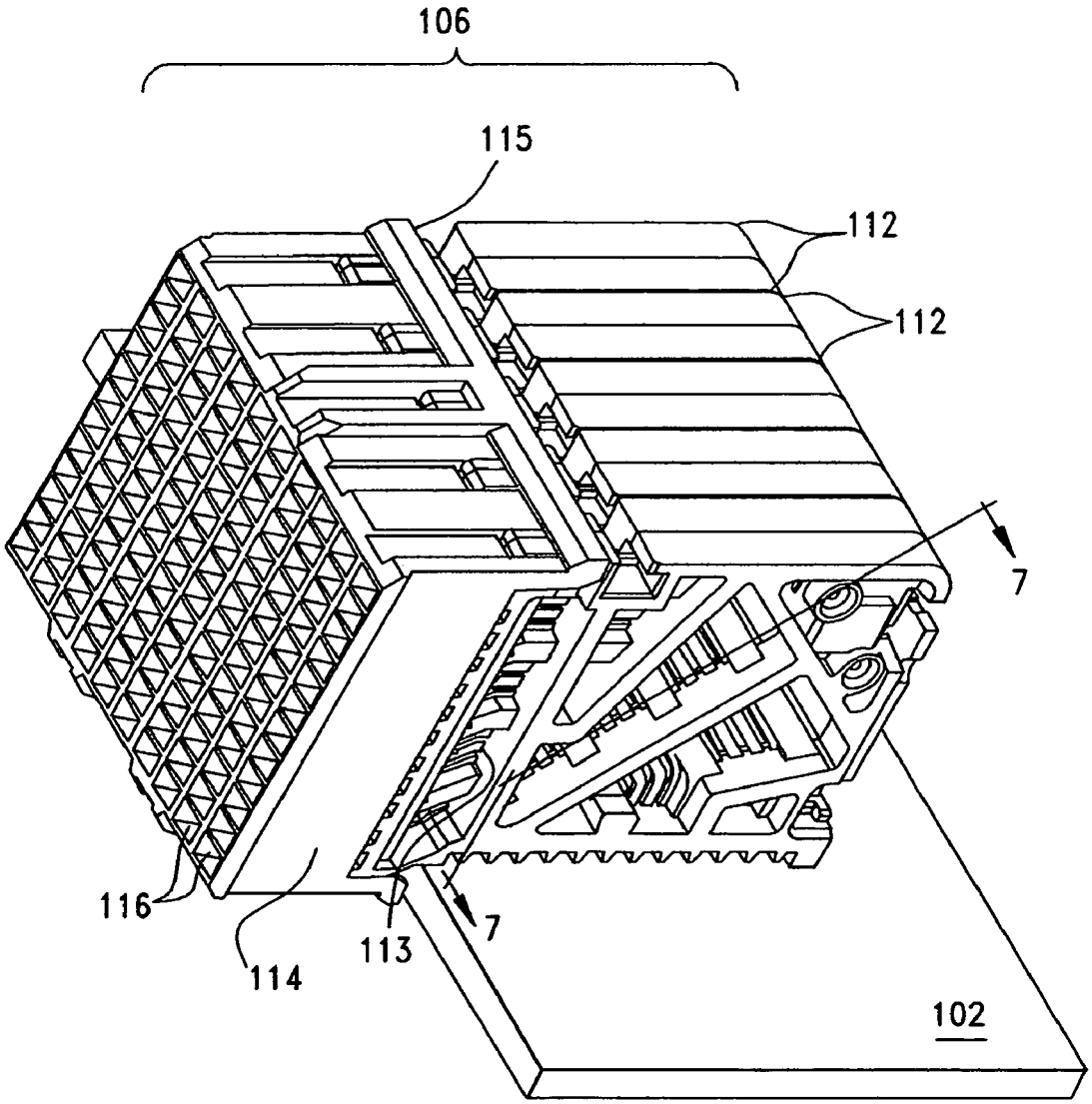
FIG. 3 is a perspective view of the doughtier card connector of FIG. 2, at a different angle thereof, illustrating it with a front cover, or shroud, applied to the individual connector units.

Turning to FIG. 3, the daughter card connector 106 is composed of a plurality of discrete connector units 112 that house conductive terminals 113 with tail portions 113*a* and contact portions 113*b* (FIG. 4) disposed at opposite ends of the terminals. The terminal contact portions 113*b* are joined to the terminal tail portions 113*a* by intervening body portions 113*c*. These body portions 113*c*, extend, for the most part through the body portion of the connector unit, from approximately the base frame-member 131 to the additional vertical frame member 135. The connector units 112 have their front ends 115 inserted into a hollow receptacle formed within a front cover, or shroud, 114. The shroud 114 has a plurality of openings 116 aligned with the pins 111 of the backplane connector 108, so that when the daughter card connector 106 is inserted into the backplane connector 108, the pins are engaged by the contact portions 113*b* of the terminals 113 of the daughter card connector 106. The connector units 112 may be further held together with a stiffener, or brace 117 that is applied to the rear surfaces 118 of the connector units 112.

Figure 8A:
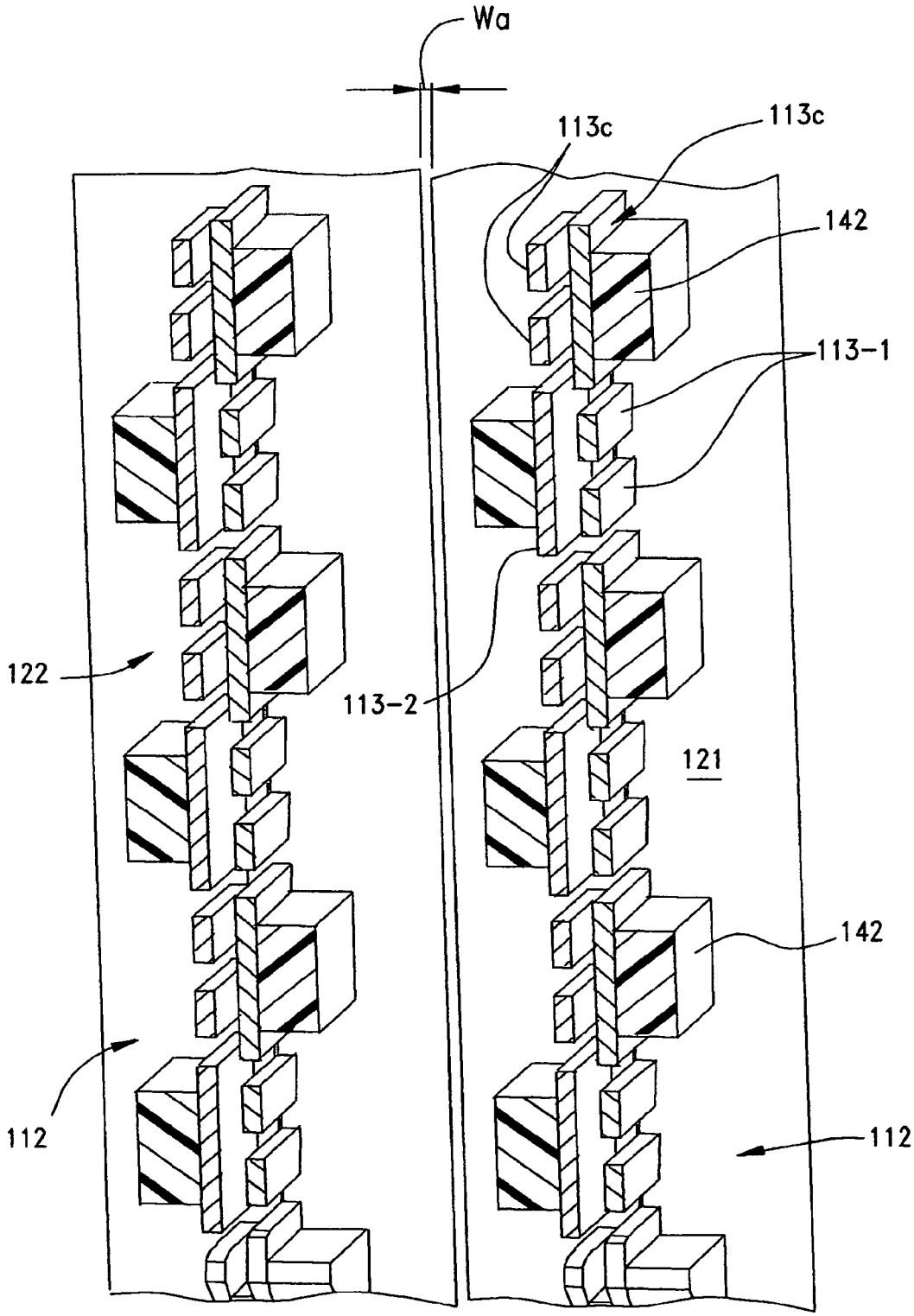
FIG. 8A is a slight perspective view of the sectioned face of the daughter card connector of FIG. 7, illustrating three adjacent connector units, or wafers.
Figure 8B:
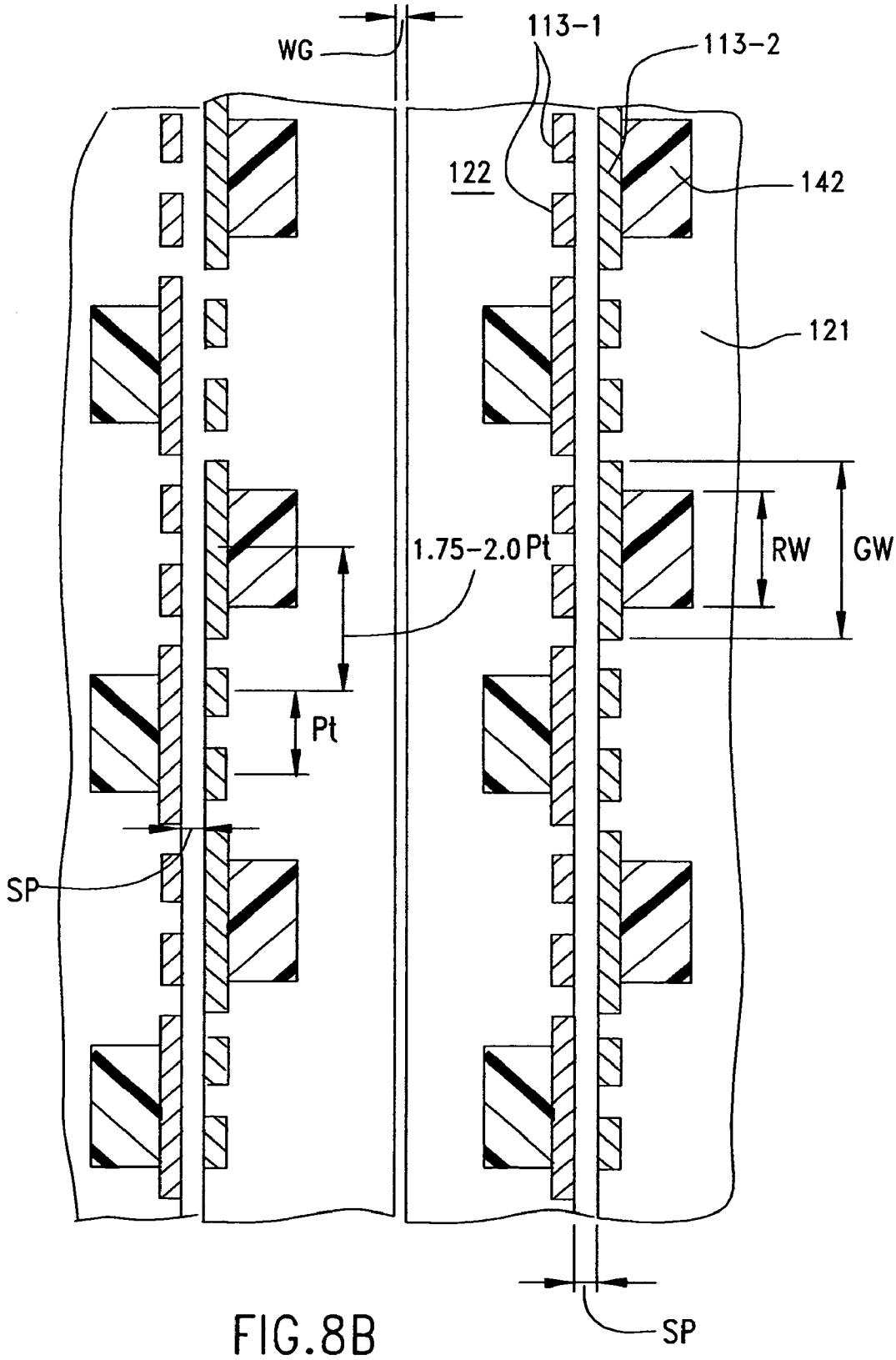
FIG. 8B is a front elevational view of FIG. 8A.
Figure 9:
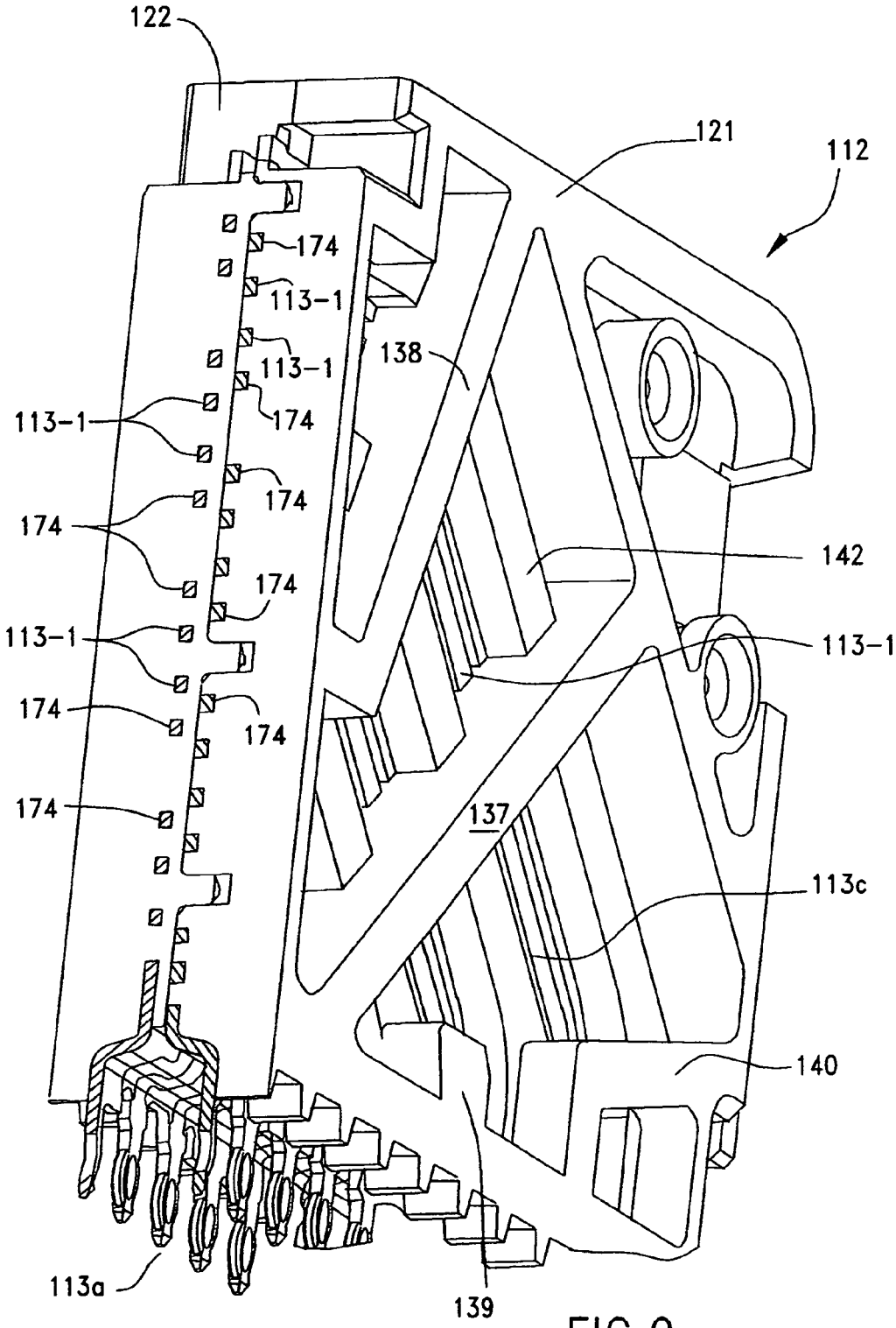
FIG. 9 is a sectional view of the daughter card connector of FIG. 2, taken along lines 9-9 thereof which is a vertical line aligned with the front vertical spoke, illustrating the arrangement of the terminals as they pass though a support frame spoke of the connector unit frame.

Each connector unit 112, in the preferred embodiment of the invention, takes the form of a wafer that is formed by the wedding, or marriage, of two waflets or halves 121, 122 together. The right hand wafer half 122 is illustrated open in FIG. 5A, while the left hand wafer half 121 is shown open in FIG. 5B. Each wafer half 121, 122 holds an array of conductive terminals 113 in a particular pattern. The array of terminals defines a "column" of terminals in the wafer half when viewed vertically from the mating end, i.e. the end of the wafer half that supports the terminal contact portions 113*b*. Thus, when two wafer halves are mated together each wafer, or connector unit 112 supports a pair of columns of terminals 113 that are spaced apart widthwise within the connector unit 112. This spacing is shown in FIG. 8B as "SP" and is provided by the interior spokes 133', 135', 137', 139, 139' and 140' shown in FIG. 5A. For reliability, the contact portions 113*b* of the terminals 113 are provided with pairs of contact arms as shown in the drawings. This bifurcated aspect ensures that the daughtercard connector terminals will contact the backplane connector pins even if the terminals are slightly misaligned.

Figure 7:
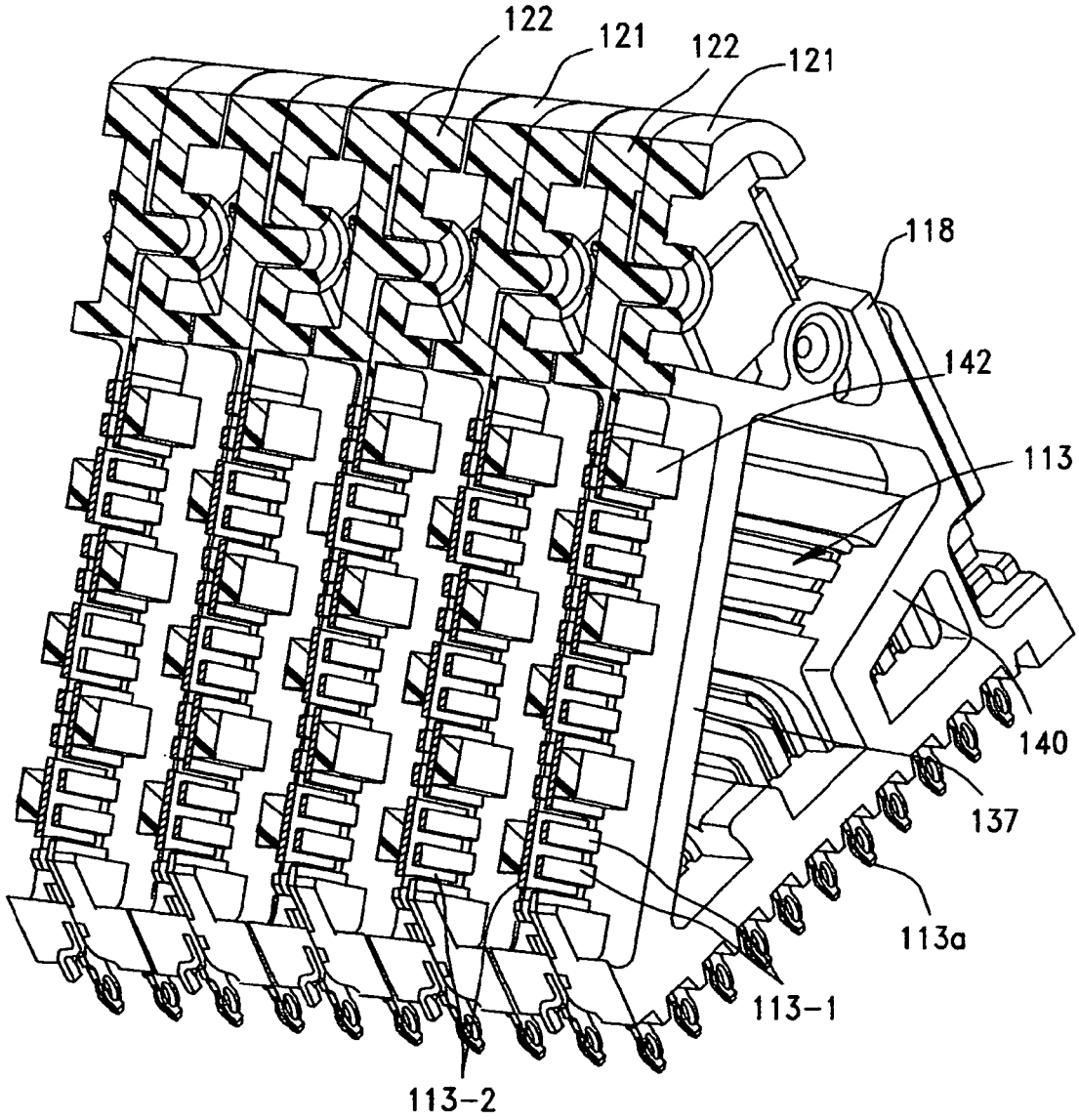
FIG. 7 is a sectional view of the daughter card connector of FIG. 2 or 3, taken along lines 7-7 thereof to expose the terminal body portions and to generally illustrate the "triad" nature of the differential signal pairs utilized in each connector unit.
Figure 7A:
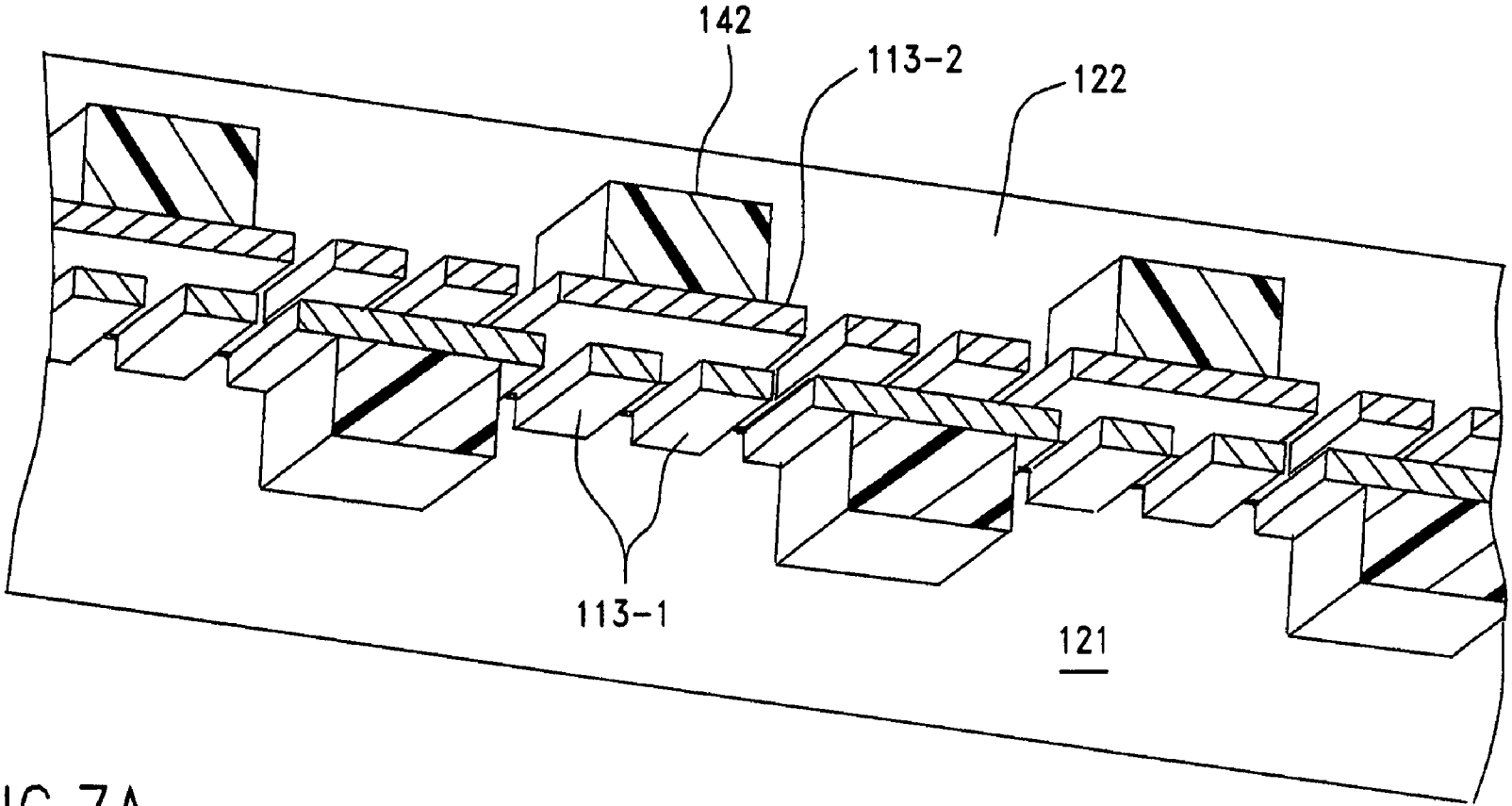
FIG. 7A is an enlarged, detailed view of one wafer of the sectioned daughter card connector of FIG. 7, specifically illustrating the "triad" nature of the terminal body portions of the daughter card connector unit.
Figure 7B:
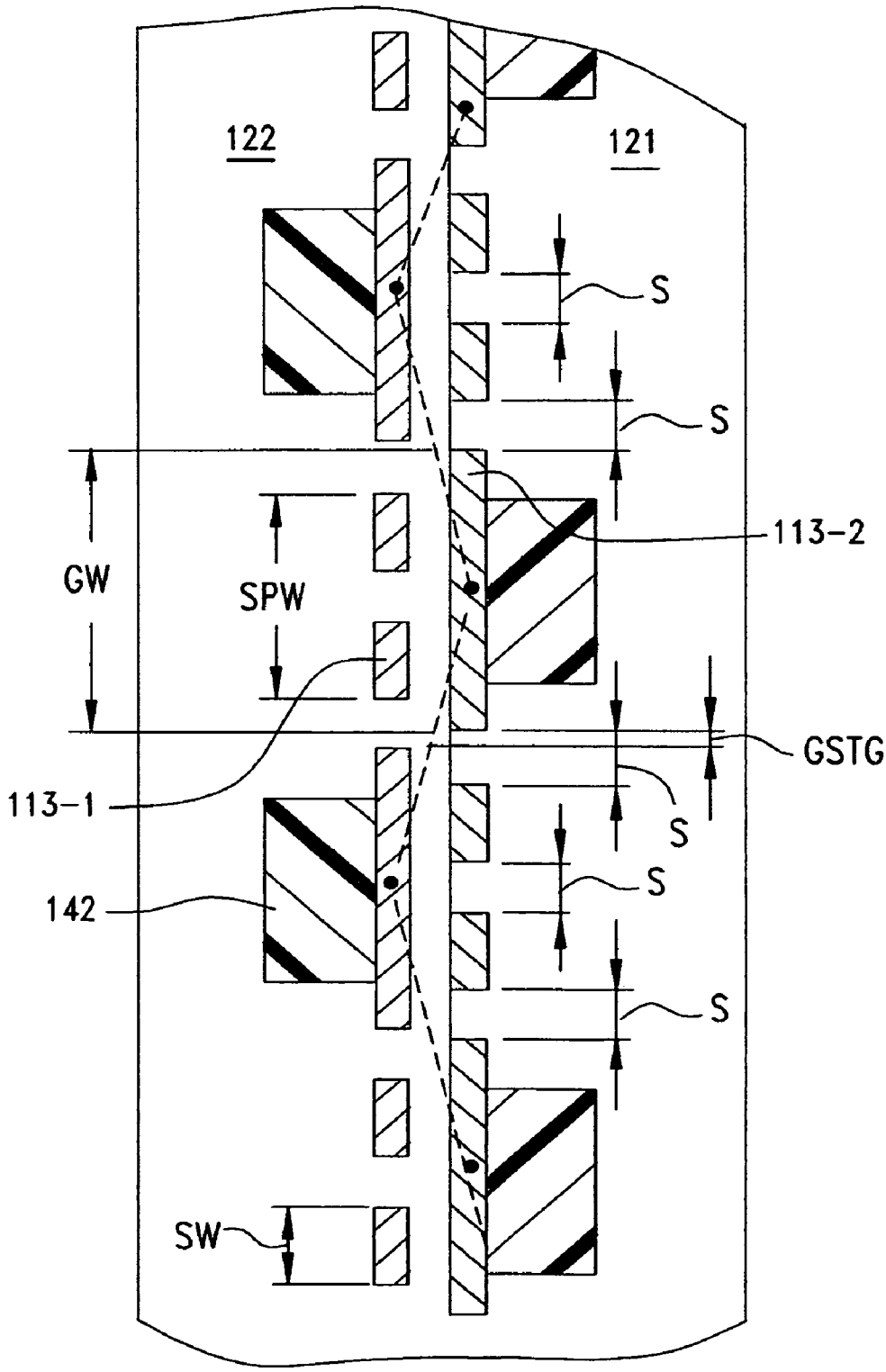
FIG. 7B is a front elevational view of the detailed view of FIG. 7A.

The connector terminals 113 are separated into two distinct types of terminals, signal terminals 113-1 and ground shield terminals 113-2. The ground shield terminals 113-2 are used to mechanically separate the signal terminals into signal terminal pairs across which differential signal will be carried when the connectors of the invention are energized and operated. The ground shield terminals 113-2 are larger than each individual signal terminal 113-1 and are also larger in surface area and overall dimensions than a pair of the signal terminals 113-1 and as such, each such ground shield terminal 113-2 may be considered as an individual ground shield disposed within the body of the connector unit 112. The dimensions and arrangement of the signal and ground shield terminals are best shown in FIG. 7B, where it can be seen that within each wafer halve, the ground shield terminals 113-2 are separated from each other by intervening spaces. These spaces contain a pair of signal terminals 113-1, which are aligned with the ground shield terminals 113-2 so that all of the terminals 113 are arranged substantially in a single line, or linear array within the column of terminals.

These signal terminals 113-1 are intended to carry differential signals, meaning electrical signals of the same absolute value, but different polarities. In order to reduce cross-talk in a differential signal application, it is wise to force or drive the differential signal terminals in a pair to couple with each other or a ground(s), rather than a signal terminal or pair of terminals in another differential signal pair. In other words, it is desirable to "isolate" a pair of differential signal terminals to reduce crosstalk at high speeds. This is accomplished, in part, by having the ground shield terminals 113-2 in each terminal array in the wafer halves offset from each other so that each pair of signal terminals 113-1 opposes, flanks or faces, a large ground terminal 113-2. Due to the size of the ground shield terminal 113-2, it primarily acts as an individual ground shield for each differential signal pair it faces within a wafer (or connector unit). The differential signal pair couples in a broadside manner, to this ground shield terminal 113-2. The two connector unit halves 121, 122 terminal columns are separated by a small spacing, shown as SP in FIGS. 8A and 8B, so that for most of their extent through the connector unit, the terminals in one column of the connector unit are separated from the terminals in the other column of the connector unit by air with a dielectric constant of 1. The ground shield terminal 113-2 also acts, secondarily, as a ground shield to the terminals of each differential signal pair 113-1 that lie above and below it, in the column or terminals (FIG. 7B). The nearest terminals of these differential signal terminal pairs edge couple to the ground shield terminal 113-2. The two terminal columns are also closely spaced together and are separated by the thickness of the interior spokes, and this thickness is about 0.25 to 0.35 mm, which is a significant reduction in size compared to other known backplane connectors.

Such a closely-spaced structure promotes three types of coupling within each differential signal channel in the body of the daughter card connector: (a) edge coupling within the pair, where the differential signal terminals of the pair couple with each other; (b) edge coupling of the differential signal terminals to the nearest ground shield terminals in the column of the same wafer half; and, (c) broadside coupling between the differential signal pair terminals and the ground shield terminal in the facing wafer half. This provides a localized ground return path that may be considered, on an individual signal channel scale, as shown diagrammatically in FIG. 7B, as having an overall V-shape when imaginary lines are drawn through the centers on the ground shield terminal facing the differential signal pair into intersection with the adjacent ground shield terminal that lie on the edges of the differential signal pair. With this structure, the present invention presents to each differential signal terminal pair, a combination of broadside and edge coupling and forces the differential signal terminal pair into differential mode coupling within the signal pair.

On a larger, overall scale, within the body of the connector, these individual ground shield terminals further cooperatively define a serpentine pseudo-ground shield within the pair of columns in each wafer. By use of the term "pseudo" is meant that although the ground shield terminals 113-2 are not mechanically connected together, they are closely spaced together both widthwise and edgewise, so as to electrically act as if there were one shield present in the wafer, or connector unit. This extends throughout substantially the entire wafer where the ground shield terminal 113-2 is larger than the signal terminals 113-1, namely from the bottom face to the vertical support face. By "larger" is meant both in surface area and in terminal width. FIG. 7B illustrates this arrangement best. The opposing edges of the ground shield terminals may be aligned with each other along a common datum line or as shown in FIG. 7B, there may be a gap GSTG disposed between the edges of the adjacent grounds, and this gap has a distance that is preferably 7% or less of the width GW of the ground shield terminal.

The ground shield terminal 113-1 should be larger than its associated differential signal pair by at least about 15% to 40%, and preferably about 34-35%. For example, a pair of differential signal terminals may have a width of 0.5 mm and be separated by a spacing of 0.3 mm for a combined width, SPW, of 1.3 mm, while the ground shield terminal 113-2 associated with the signal pair may have a width of 1.75 mm. The ground shield terminals 113-2 in each column are separated from their adjacent signal terminals 113-1 by a spacing S, that is preferably equal to the spacing between signal terminals 113-1, or in other words, all of the terminals within each column of each wafer half are spaced apart from each other by a uniform spacing S.

Figure 10A:
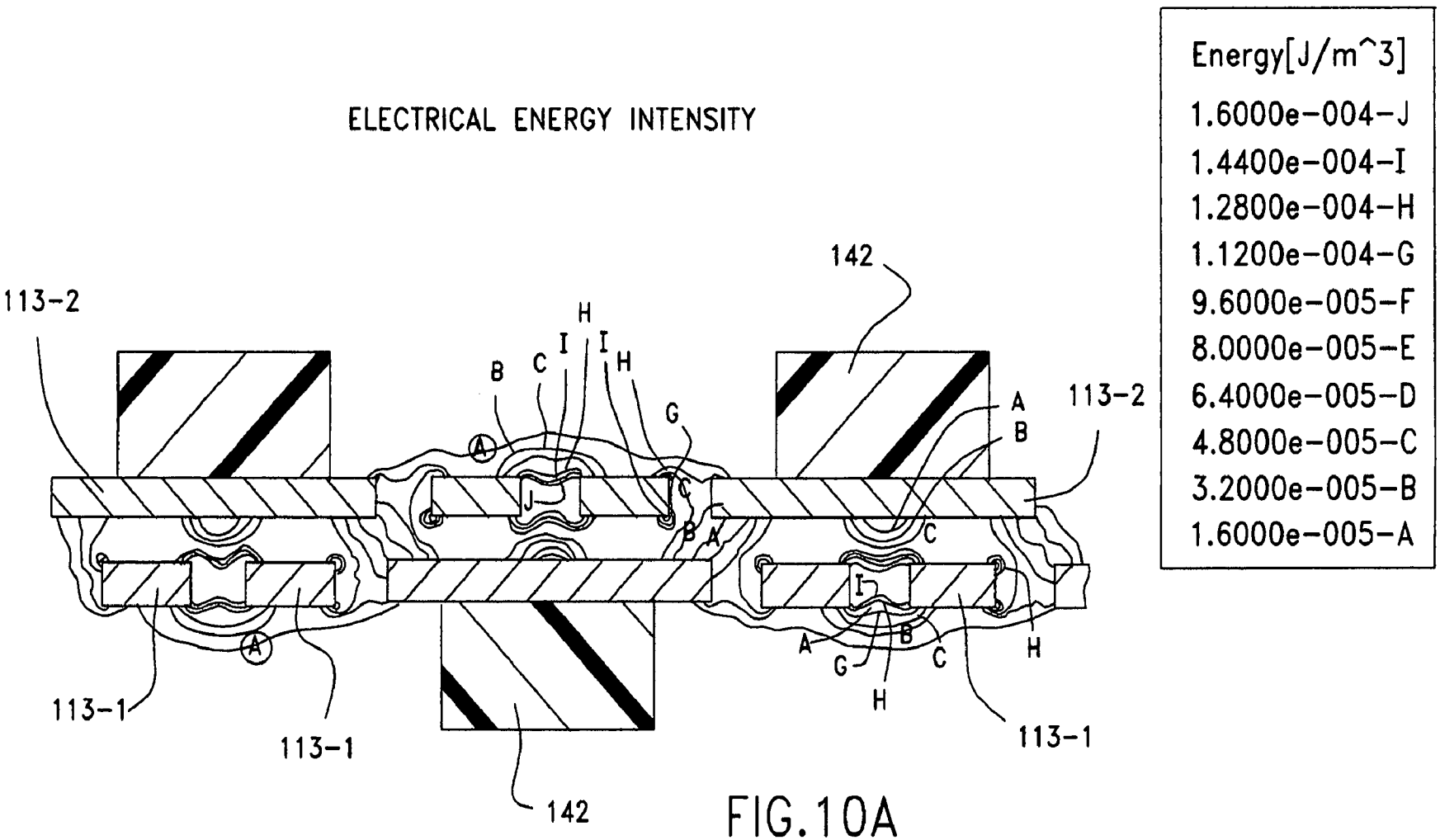
FIG. 10A is an electrical field intensity plot of the terminal body portions of two differential signal channels within the daughter card connector of FIG. 2.
Figure 10B:
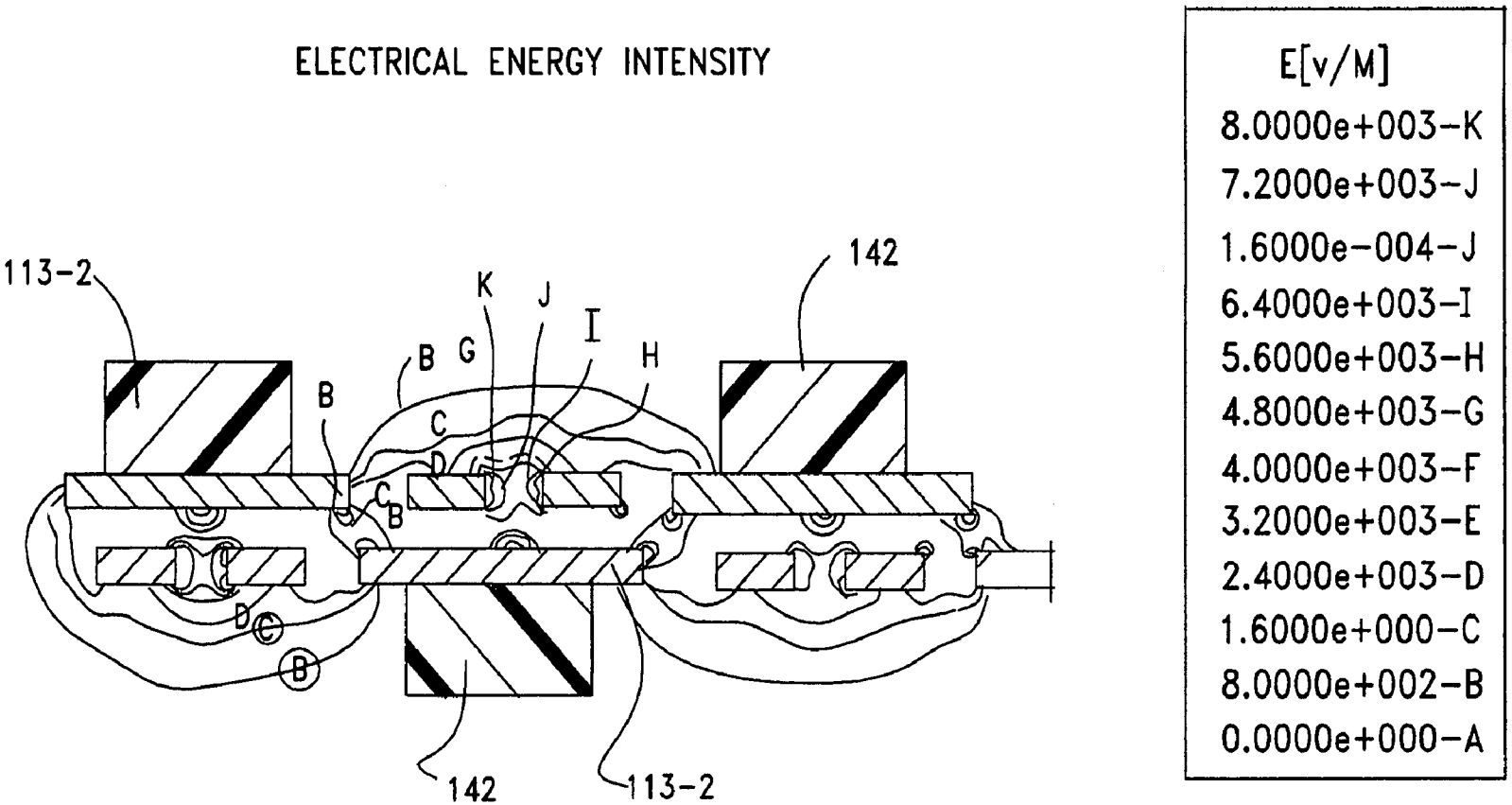
FIG. 10B is an electrical field intensity plot of the body portions of a group of six connector units of the daughtercard connector of FIG. 2.

The large ground shield terminal serves to provide a means for driving the differential signal terminal pair into differential mode-coupling, which in the present invention is edge coupling in the pair, and maintaining it in that mode while reducing any differential mode coupling with any other signal terminals to an absolute minimum. This relationship is best shown in FIGS. 10A and 10B which are respectively, electrical energy intensity and electrical field intensity plots of the terminal body portions. FIG. 10A is an electrical energy intensity plot of the triad-type structure described above. The plots were obtained through modeling a section of the body of the connector unit of the present invention in the arrangement illustrated in FIG. 7B with four differential signal terminal pairs 113-1 and four opposing ground shield terminals 113-2, using ANSOFT HFSS software, in which a differential voltage was assigned to the two signal terminals 113-1 of the pair and the electrical field and energy intensities generated.

These models demonstrate the extent of coupling that will occur in the connectors of the invention. The magnitude of the energy field intensity that occurs between the edges of the two terminals in each differential signal pair, as shown in FIG. 10A, ranges from 1.6 to $1.44\times10^{-4}$ Joule/meter$^3$, while the magnitude of the energy intensity between the two angled edges of the signal terminal pairs between the columns diminishes down to $1.6\times10^{-5}$ and approaches zero, demonstrating the isolation that can be obtained with the present invention. Similarly FIG. 10B expresses the electrical field intensity in volts/meter and it shows the field intensity between the edges of the coupled differential signal terminal pair as ranging from $8.00\times10^3$ while the field intensity reduces down to 2.40 to 0.00 volts/meter on the angled path that interconnects the edges of two adjacent differential signal terminal pairs.

Figure 11B:
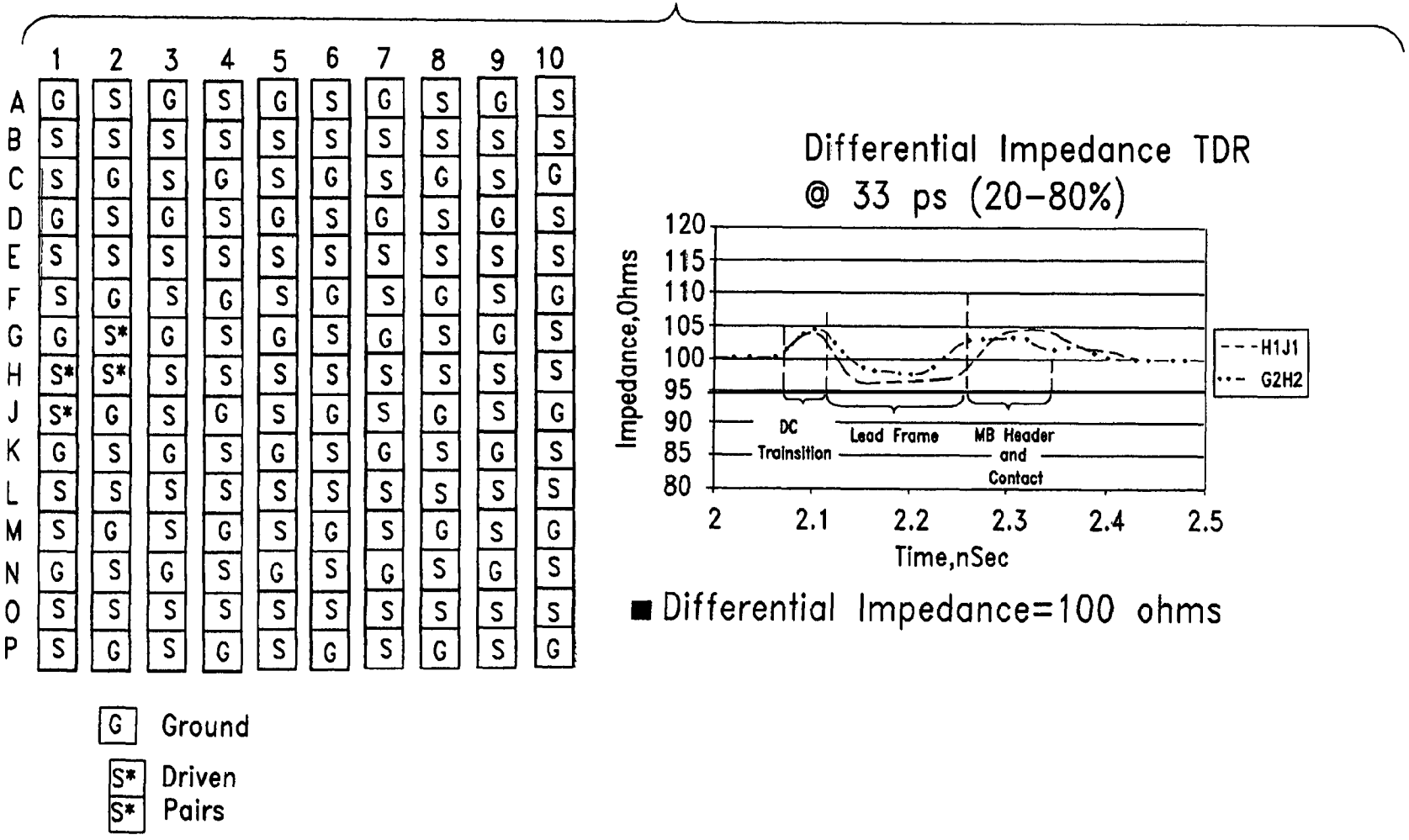
FIG. 11B is an impedance plot of a pair of differential signal terminals chosen from the pin map of FIG. 11A identifying the impedance obtained from a simulation of a connector of the present invention.
Figure 11C:
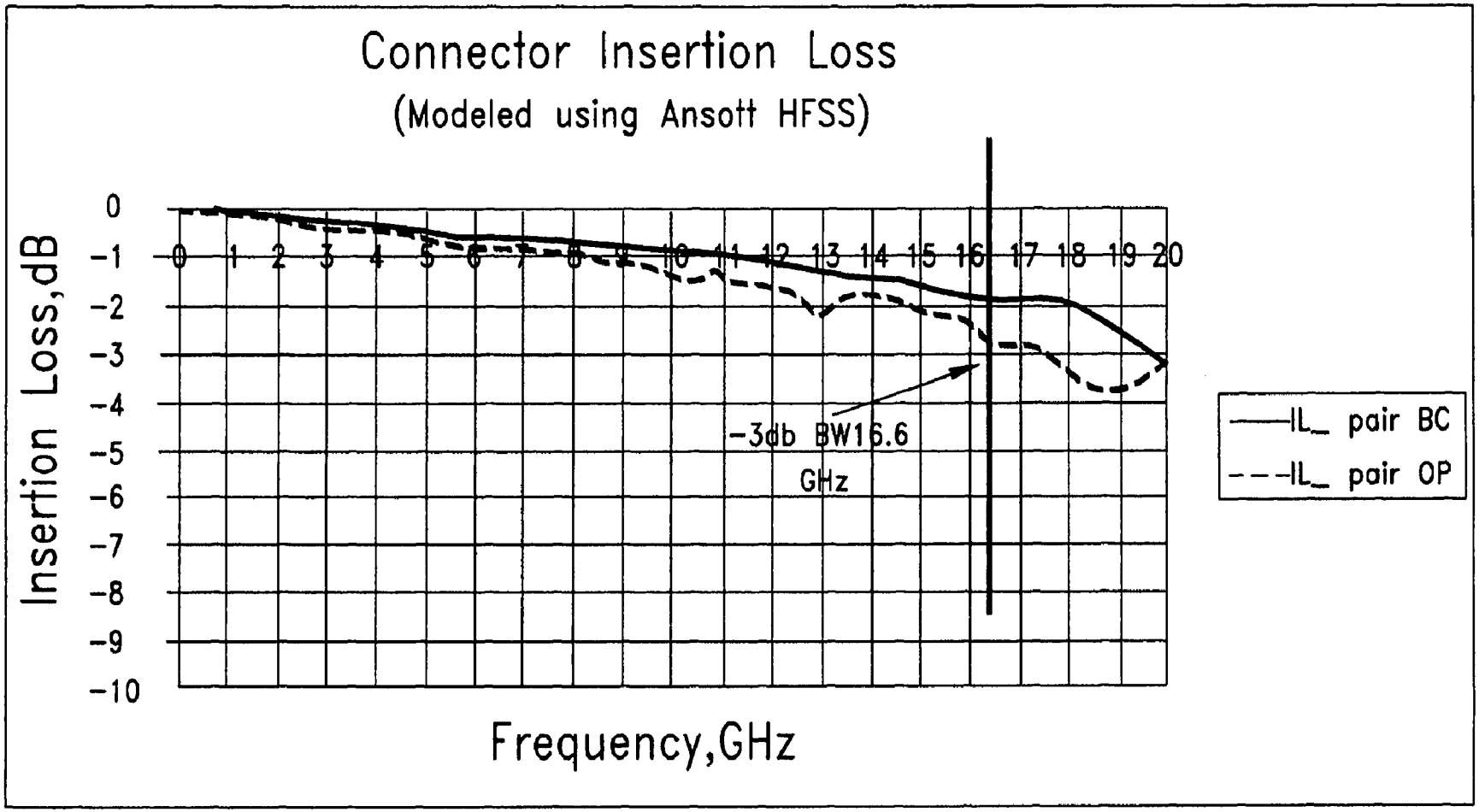
FIG. 11C is a connector insertion loss plot obtained through modeling the connectors of the invention illustrating the minimum and maximum losses incurred and a −3 db loss at a frequency of 16.6 GHz.
Figure 11D:
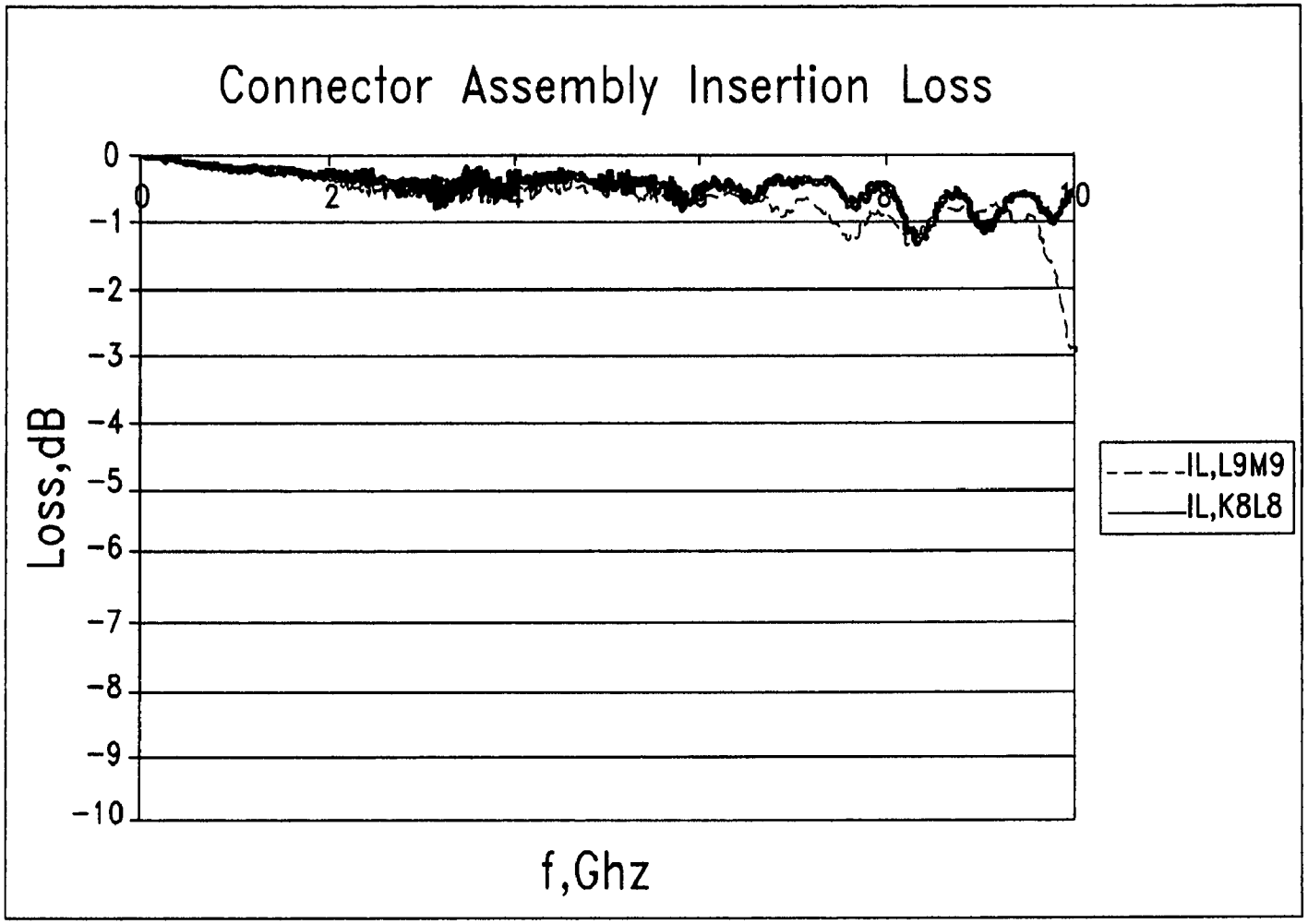
FIG. 11D is a connector assembly insertion loss plot which illustrates the results of actual testing of the connector assembly of FIG. 1 in place in two circuit boards, illustrating an insertion loss of −3 db at a speed of about 10 GHz.

FIGS. 11C and 11D illustrate the modeled and measured insertion loss of connectors of the invention. FIG. 11C is an insertion loss plot of the connector as shown in FIG. 1, less the two circuit boards and it shows the maximum and minimum loss values obtained using ANSOFT HFSS from the differential signal pairs in rows BC and OP (corresponding to the pin map of FIG. 11A). It indicates that the connector should have a loss of −3 db at a frequency of about 16.6 GHz, which is equivalent to a data transfer rate of 33.2 Gigabits/second. FIG. 11D is an insertion loss plot obtained through testing of an early embodiment of the connector of FIG. 1, including its circuit boards. Again, the maximum and minimum losses are plotted for differential signal pairs at L9M9 and K8L8 and the insertion loss is −3 db at about 10 GHz frequency, which is equivalent to a data transfer rate of about 20 Gigabits/second.

Figure 12:
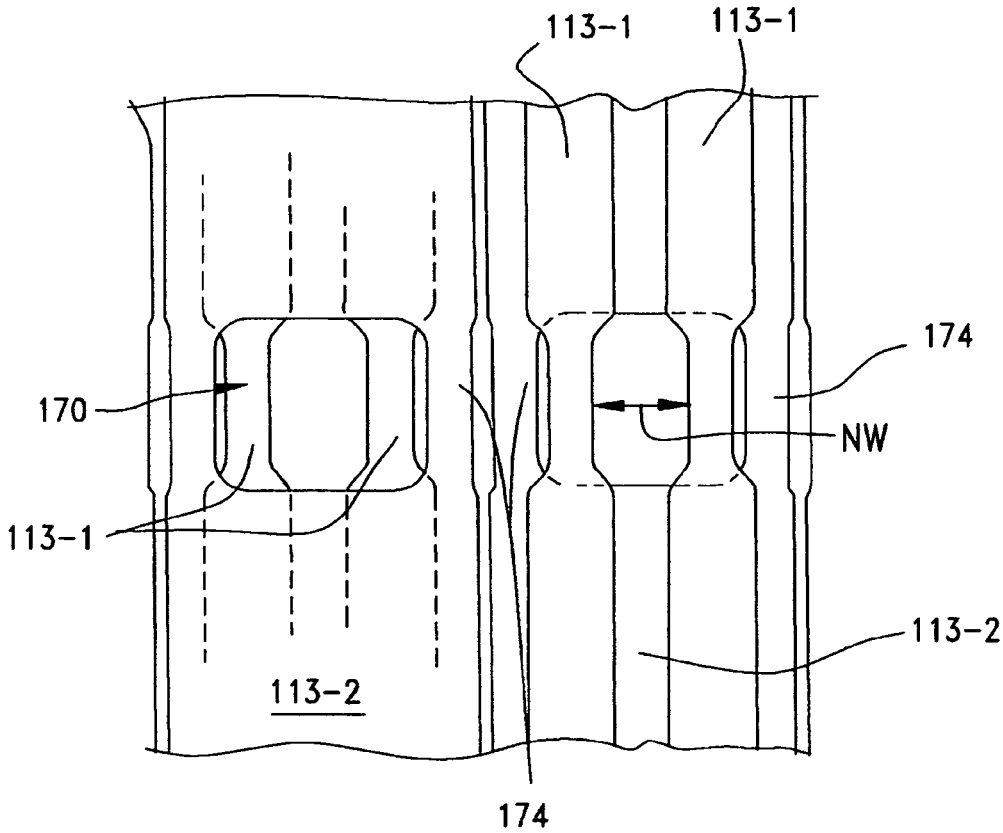
FIG. 12 is an enlarged detail view of the area where the terminal array of the connector crosses a support frame spoke of the connector unit.

FIG. 11A is a crosstalk pin map representing the pin layout of a connector constructed in accordance with the principles of the present invention and as shown in FIG. 1. In order to identify the relevant terminals of the connector, the rows of terminal have an alphabetical designation extending along the left edge of the map, while the columns are designated numerically along the top edge of the map. In this manner, any pin may be identified by a given letter and number. For example, "D5", refers to the terminal that is in the "D" row of the "5" column. A victim differential signal pair was tested by running signals through four adjacent differential signal pairs that are designated in FIG. 12 as "aggressor" pairs. Two of the six surrounding adjacent pairs are identical or mirror images of their counterparts so that only four of the six aggressor pairs were tested, as is common in the art. The testing was done with a mated daughtercard and backplane connector mounted in place on circuit boards, at a rise time of 33 picoseconds (20-80%) which is equivalent to a data transfer rate of approximately 10 gigabits per second through the terminals. As can be seen in the table below, the cumulative near end crosstalk (NEXT) on the victim pair was 2.87% and the far end crosstalk (FEXT) was 1.59%, both values being below 3%, and FIG. 11B is a plot of the differential impedance (TDR) modeled through the connector using signals at a 33 picosecond (ps) rise time (20-80%) taken along the differential signal terminal pairs, H1-J1 and G2-H2 of FIG. 11A.

The impedance achieved is approximately +/−10% of the desired baseline 100 ohm impedance through the connector assembly and circuit boards at a 33 picosecond rise time. The various segments of the connector assembly are designated on the plot. The impedance rises only about 5 ohms (to about 103-104 ohms) in the transition area of the daughter card connector 106 where the terminal tail portions expand to define the terminal body portions, and the impedance of the pair terminal body portions, where the large ground shield terminals 113-2 are associated with their differential signal terminal pairs drops to about 6-8 ohms (to about 96-97 ohms) and remains substantially constant through the connector unit support frame. As the daughter card connector terminal contact portions 113*b* make contact with the terminals 111 of the backplane connector 108, the impedance rises about 6-8 ohms (to about 103-104 ohms), and then the impedance through the backplane connector (pin header) 108 reduces down toward the baseline 100 ohm impedance value. Thus, it will be appreciated that connectors of the invention will have low cross-talk while maintaining impedance in an acceptable range of +/−10%.

Returning to FIG. 4, each wafer half has an insulative support frame 130 that supports its single column of conductive terminals. The frame 130 has a horizontal base part 131 with one or more standoffs 132, in the form of posts or lugs, which make contact with the surface of the daughter card where the daughter card connector is mounted thereto. It also has a vertical front part 133. These parts may be best described herein as "spokes" and the front spoke 133 and the base spoke 131 mate with each other to define two adjacent and offset surfaces (or edges) of the connector unit and also substantially define the boundaries of the frame where the body portions 113*c* of the terminals 113 extend. That is to say, the body portions 113*c* of the terminals 113, the area where the ground shield terminals 113-2 are wider and larger than their associated differential signal terminal pair extend between the base and front spokes 131, 133.

Figure 4:
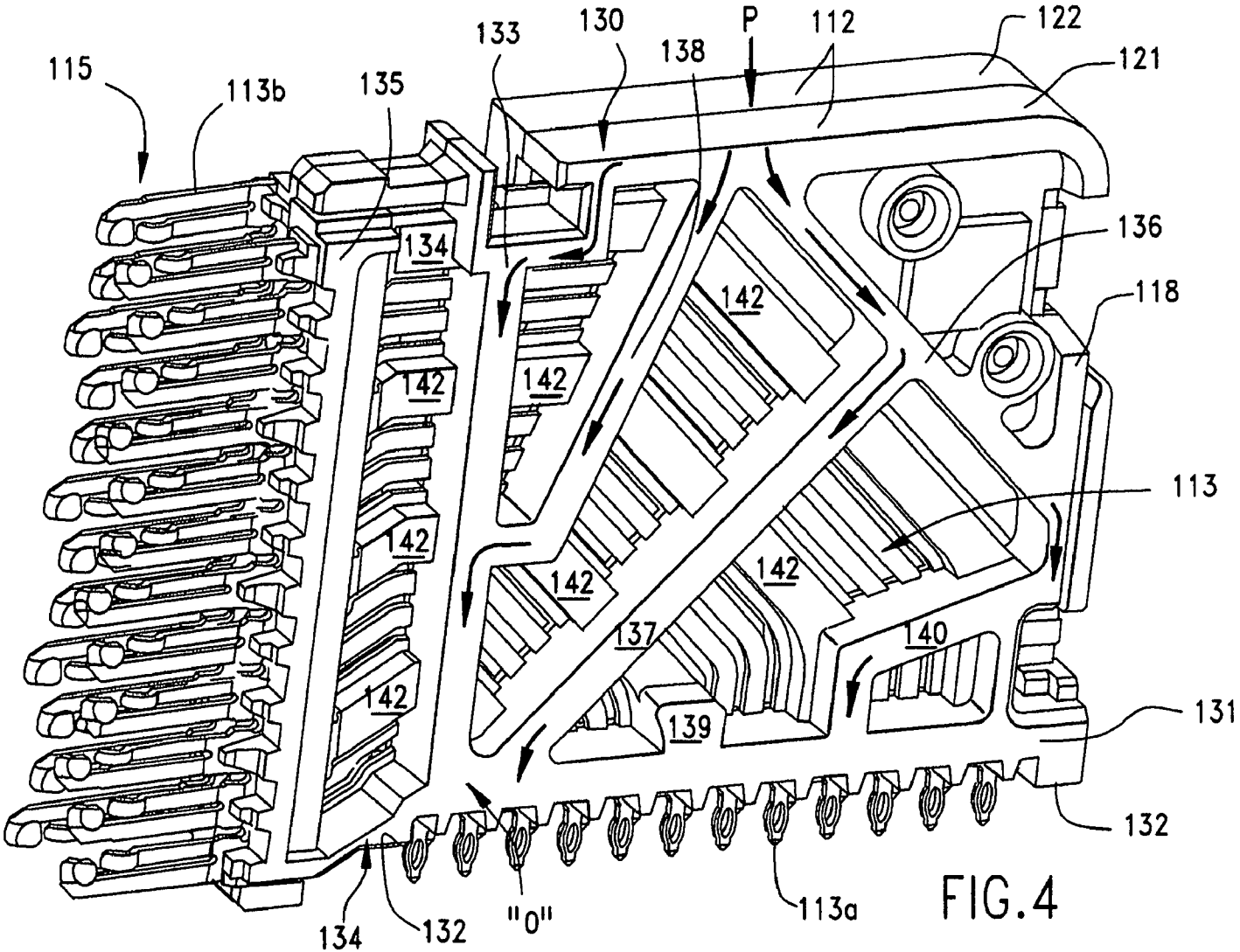
FIG. 4 is a slight perspective view of one connector unit that is sued in the connector of FIG. 3, and shown in the form of a wafer assembly.

The bottom spoke 131 and the front spoke 133 are joined together at their ends at a point "O" which is located at the forward bottom edge of the connector units 112. From this junction, a primary radial spoke 137 extends away and upwardly as shown in a manner to bisect the area between the base and vertical spoke 135 into two parts, which, if desired, may be two equal parts or two unequal parts. Two such equal parts are shown in FIGS. 4, 5A, 5B and 9. This radial spoke 137 extends to a location past the outermost terminals in the connector unit 112. Additional spokes are shown at 138, 139 & 140. Two of these spokes, 138 and 139 are partly radial in their extent because they terminate at locations before the junction point "O" and then extend in a different direction to join to either the vertical front spoke 135 or the base spoke 131. If their longitudinal centerlines would extend, it could be seen that these two radial spokes would emanate from the junction point "O". Each terminus of these two part-radial spokes 138, 140 occurs at the intersection with a ground shield rib 142, the structure and purpose of which is explained to follow. The radial spokes are also preferably arranged in a manner, as shown in FIG. 4, to evenly transfer the load imposed on the connector units to the top parts of the compliant pin terminal tail portions when the connector units are pressed into place upon the daughter card 102. Consistent with force transfer principles, when the connectors of the invention are pressed into a daughter card, an insertion force P, (FIG. 4) is applied to the top of the connector units and the insertion force is transferred, as shown along the primary spoke 137 and the two secondary spokes 138, 140, including the spoke 136 that interconnects the primary spoke 137 (on the outside of the connector half) and the two secondary spokes 138, 140 as shown in FIG. 4. It extends in a similar manner in FIG. 5A and is denoted 136' therein. This force transfer and distribution lessens any bending forces that the top member of the connector unit may incur. It is preferred that the two spokes 136, 138 meet the top of the connector together as shown in FIG. 4.

The ribs 142 of the support frame provide the ground shield terminals with support (on their outer surfaces) but also serve as runners in the mold to convey injected plastic or any other material from which the connector unit support frames are formed. These ribs 142 are obviously open areas in the support frame mold and serve to feed injected melt to the spokes and to the points of attachment of the terminals to the support frame. The ribs 142 preferably have a width RW as best shown in FIG. 8B, that is less than the ground shield terminal width GW. It is desired to have the width of the rib 142 less than that of the ground shield terminals 113-2 so as to effect coupling between the edge of a differential signal terminal pair facing the edge of the ground shield terminal 113-2 and its rib 142 so as to deter the concentration of an electrical field at the ground terminal edges, although it has been found that the edges of the rib 142 can be made coincident with the edges of the ground shield terminals 113-2. However, keeping the edges of the ribs 142 back form the edges of the ground shield terminals 113-2 facilitates molding of the connector units for it eliminates the possibility of mold flash forming along the edges of the ground shield terminal and affecting the electrical performance thereof. The ground shield terminal also provides a datum surface against which mold tooling can abut during the molding of the support frames. As shown in FIG. 8A and as utilized in one commercial embodiment of the present invention, the backing ribs 142 have a width that ranges from about 60 to about 75% of the width of the ground shield terminal 113-2, and preferably have a width of about 65% that of the ground shield terminal.

Figure 6:
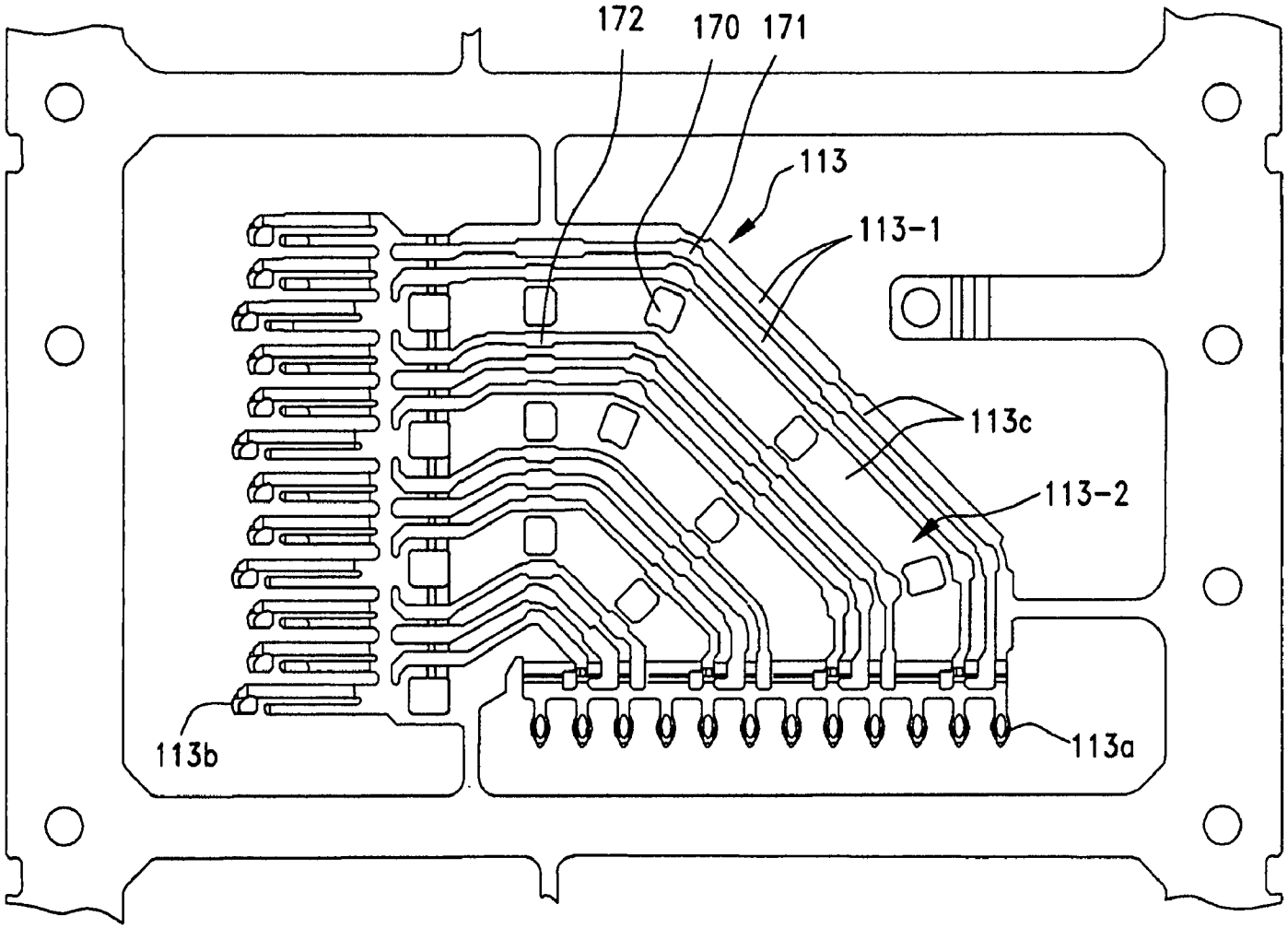
FIG. 6 is a plan view of the terminal assembly used in each half of the connector unit of FIG. 4, shown held in a metal leadframe and prior to singulation and overmolding thereof.

FIG. 4 further shows an additional vertical spoke 135 that is spaced apart forwardly of the front spoke 133 and is joined to the connector unit 122 by way of extension portions 134. This additional vertical spoke encompasses the terminals at the areas where they transition from the terminal body portions to the terminal contact portion 113*b*. In this transition, the large ground shield terminals are reduced down in size to define the bifurcated format of the terminal contact portions 113*b* as shown best in FIGS. 6 and 9.

Figure 5A:
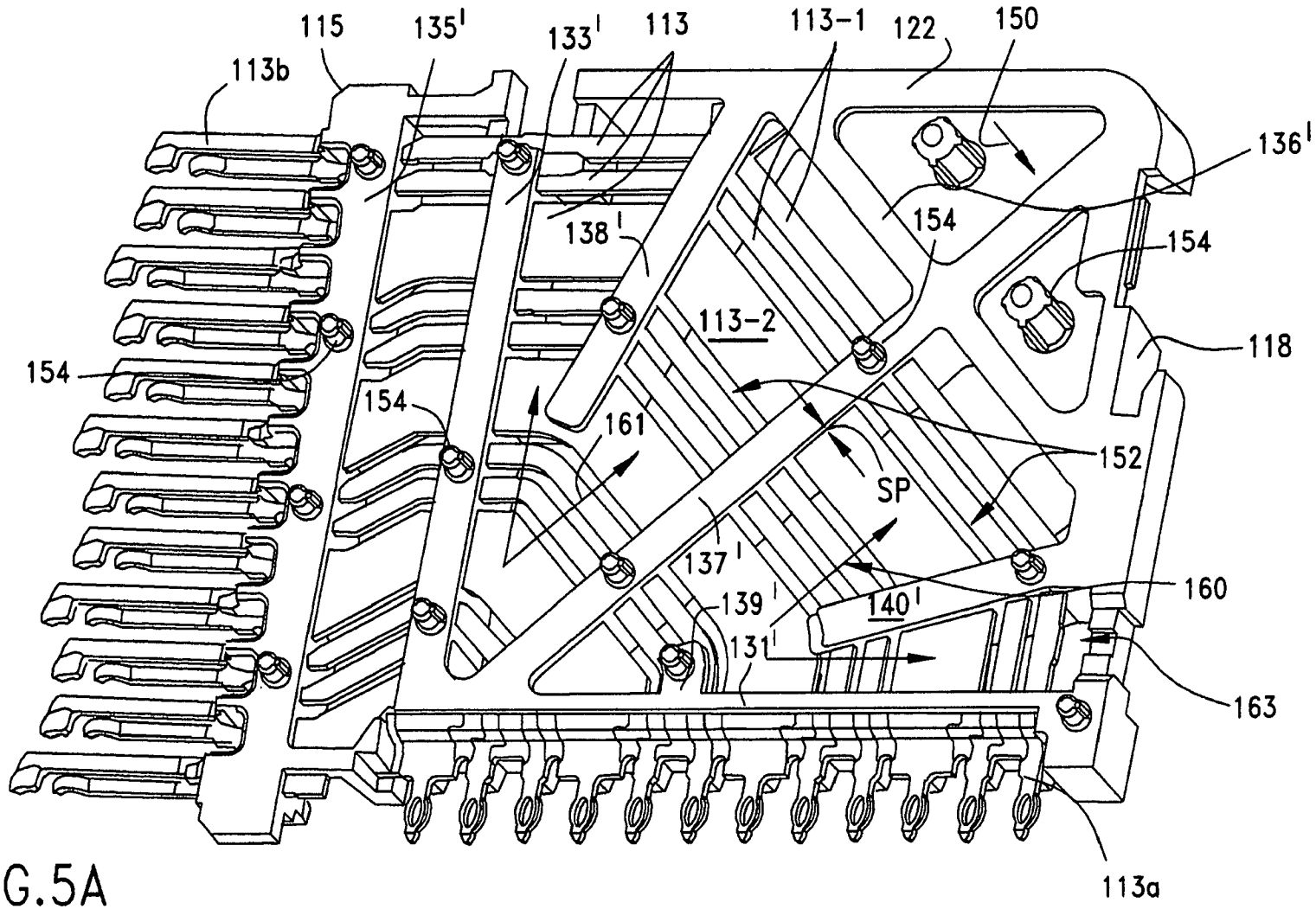
FIG. 5A is an interior view of the right hand wafer half of the connector unit of FIG. 4.

As shown in FIG. 5A, the radial spokes 133, 135, 137, 138, 139 and 140 may be considered as partially continuing on the interior surface 150 of one of the connector unit wafer halves 122, in this Figure, the right hand wafer half is shown, but it will be understood that the left hand wafer half could be used in place thereof. These elements serve as stand-offs to separate the columns of two terminals 113 apart from each other when the two connector unit wafer halves 121, 122 are joined together to form a connector unit 112. The interior surface 150 in FIG. 5A illustrates 6 such spoke elements. One is base interior spoke 131' that intersects with front vertical interior spoke 133 at the junction "O". Another, or primary interior spoke 137' extends as a bisecting element in a diagonal path generally between two opposing corners of the connector unit wafer half 122, starting at "O". Two other, or secondary radial, interior spokes 138', 140' extend between the bisecting interior spoke 137' and the base and front interior spokes 131' and 133'. In the preferred embodiment illustrated, the other radial interior spokes 138', 140' are positioned between the radial interior spoke 137' and the base and front interior spokes 131' and 133' so as to define two V-shaped areas in which air is free to circulate.

The connector unit wafer half 122 may be provided with a means for engaging the other half and is shown in the preferred embodiment as a plurality of posts 154. The posts 154 are formed in the area where the differential signal terminals are narrowed, and oppose the ground shield terminal windows 170. Each spoke member contains a corresponding recess 155 that receives the posts 154. The inner spokes also serve to provide the desired separation SP between the columns of terminals 113 in the connector unit 112. In this regard, the inner spokes also serve to define two V-shaped air channels that are indicated by the arrows 160, 161 in FIG. 5A. Both of these V-shaped air channels are open to the exterior of the connector unit through the slots 163 that bound the topmost terminals in either of the connector unit wafer halves. It is preferred to extend only the primary, or bisecting spoke down to the junction point "O" so as to minimize the amount of plastic or molding material that will cover the inner surfaces of the terminals of the right hand wafer half shown in FIG. 5A. In this manner, the impedance within the connector unit interiors may be better controlled and signal loss may be minimized.

Figure 5B:
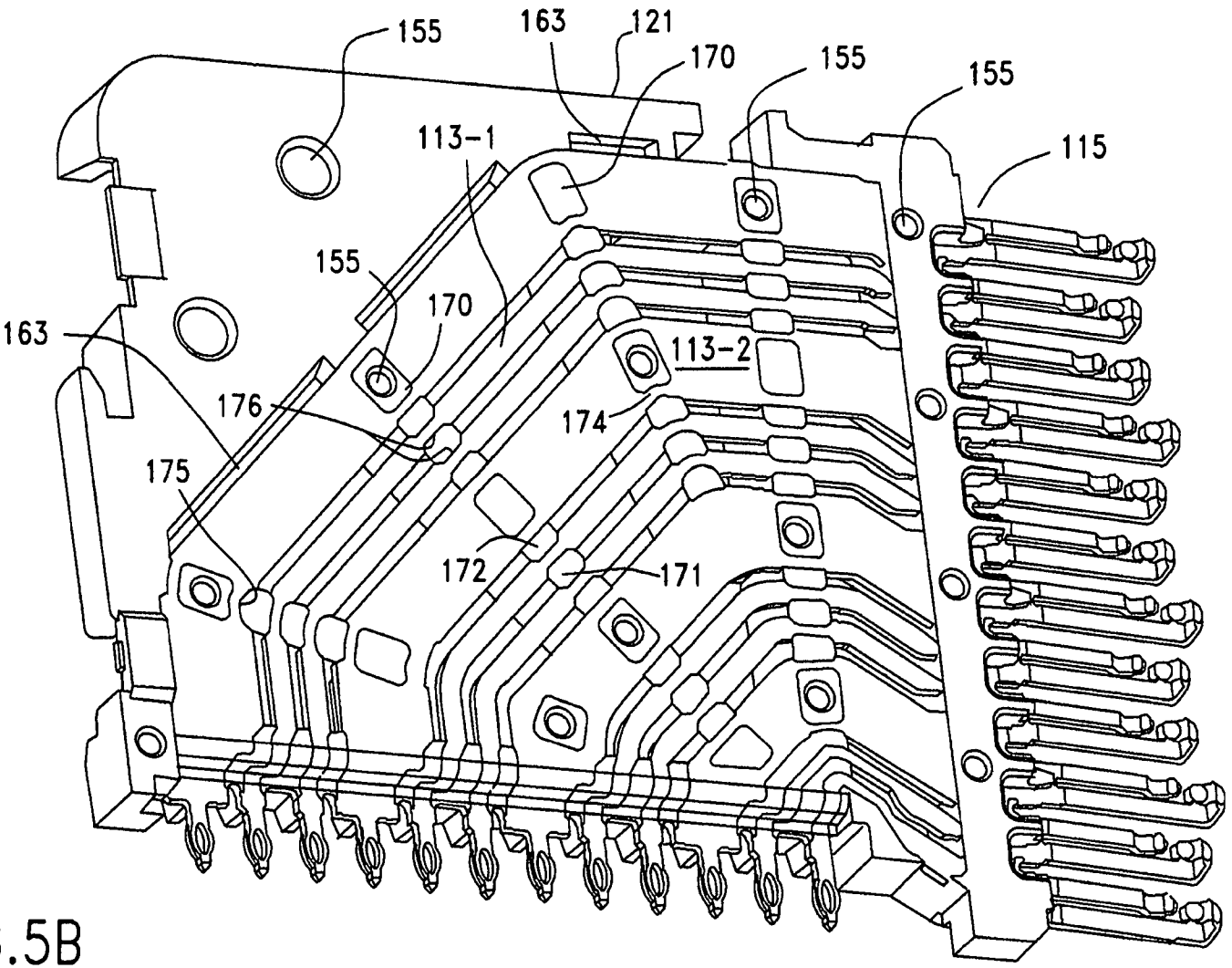
FIG. 5B is an interior view of the left hand wafer half of the connector unit of FIG. 4.

The opposing connector unit wafer half 121 as shown in FIG. 5B, includes a plurality of recesses, or openings, 155 that are designed to receive the posts 154 of the other wafer half 122 and hold the two connector unit wafer halves 121, 122 together as a single connector unit 112. In the areas where the two connector halves 121, 122 are joined together the impedance of the connector units 112 is controlled by reducing the amount of metal present in the signal and ground terminals 113-1, 113-2. This reduction is accomplished in the ground shield terminals 113-2 by forming a large, preferably rectangular window 170 in the terminal body portion 113*c* that accommodates both the posts 154 and the plastic of the connector unit support frame halves. Preferably, these windows have an aspect ratio of 1.2, where one side is 1.2 times larger than the other side (1.0). This reduction is also accomplished in the signal terminals by "necking" the signal terminal body portions 113*c* down so that two types of expanses, or openings 171, 172 occur between the differential signal terminal pair and the terminals 113-1 of that pair and the ground shield terminal 113-2, respectively. The narrowing of the terminal body portions in this area increases the edge to edge distance between the differential signal terminal pair, which there by affects its coupling, as explained below.

Figure 13:
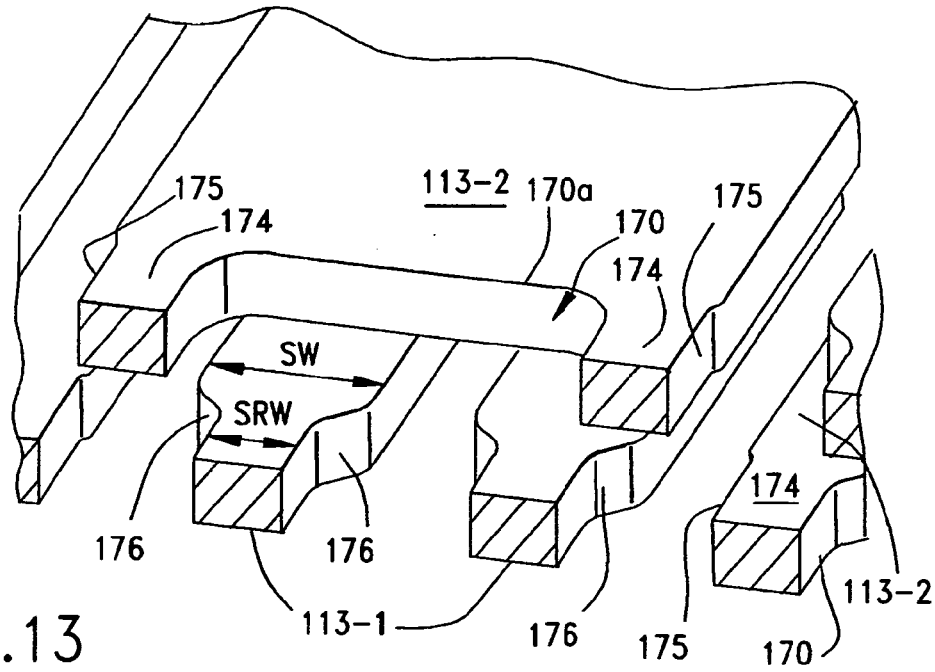
FIG. 13 is a sectioned view of the area of FIG. 12, illustrating the relative positions of the signal pair and ground shield terminals in the area where they are joined to the support frame of the two wafer halves.
Figure 14:
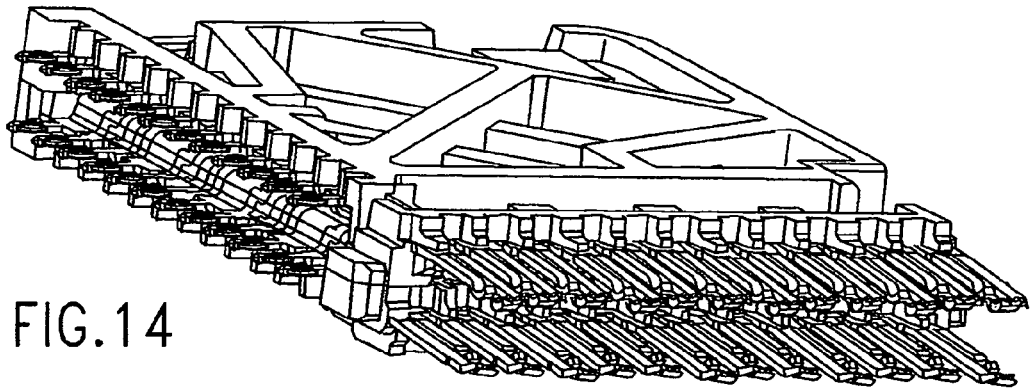
FIG. 14 is perspective view of a connector unit of the present invention used in the connector of FIG. 2, and turned upside down for clarity purposes in order to illustrate the ends of the body portions of the terminals and the tail portions that extend therefrom.
Figure 15:
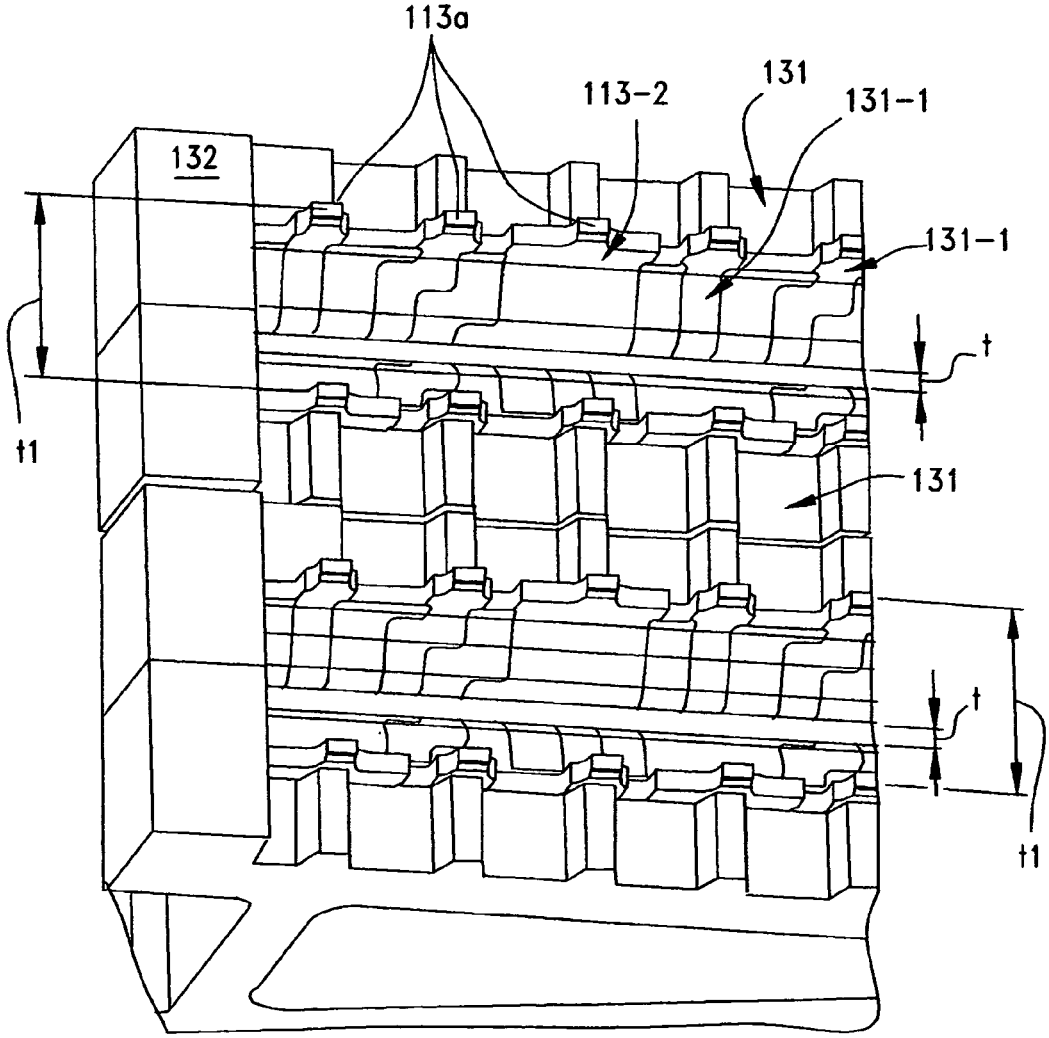
FIG. 15 is an enlarged detail view of the bottom of two connector units of the present invention illustrating the tail portions as they extend away from the terminal body portion ends.
Figure 16:
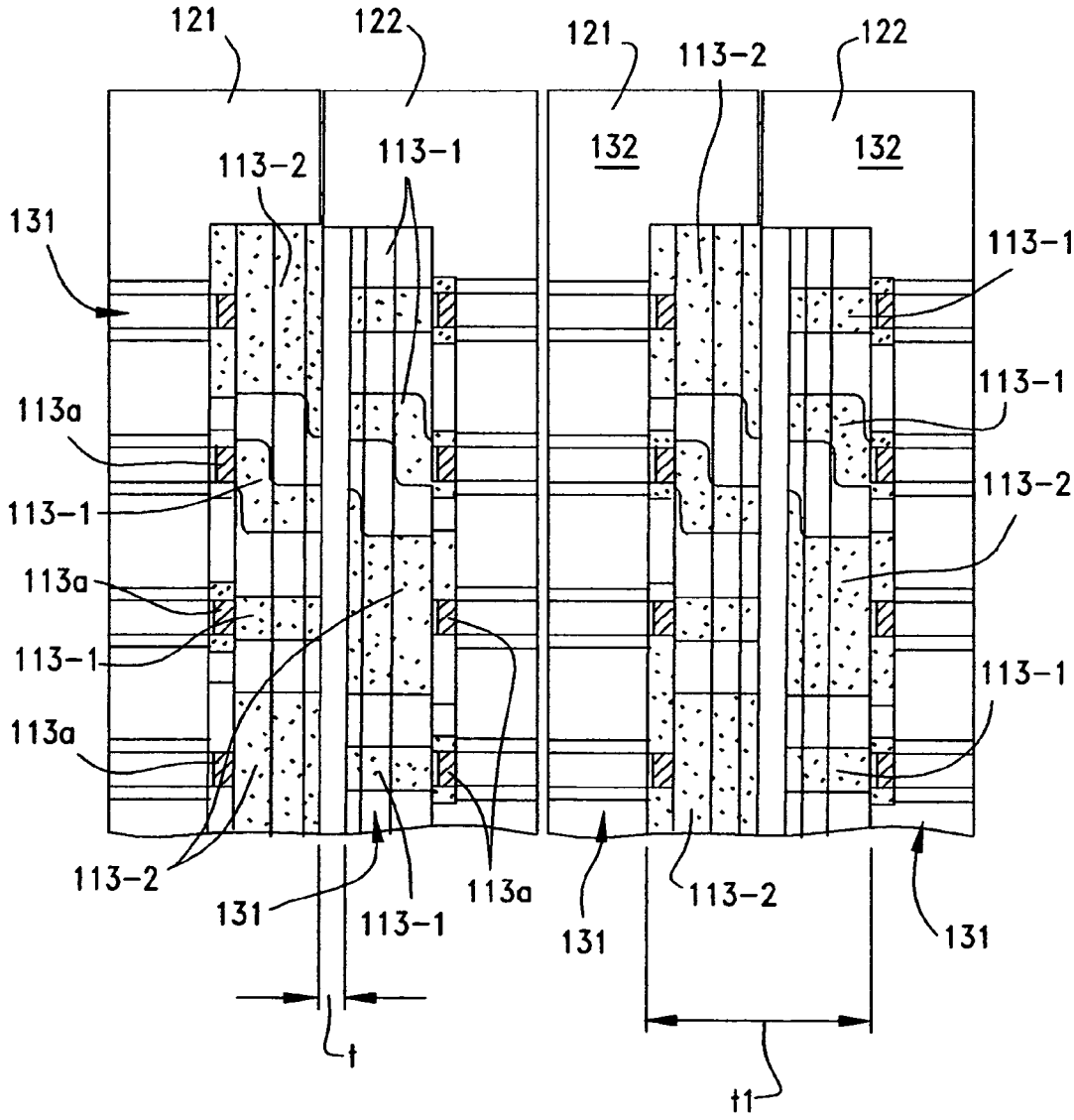
FIG. 16 is a bottom plan view of FIG. 15.
Figure 17:
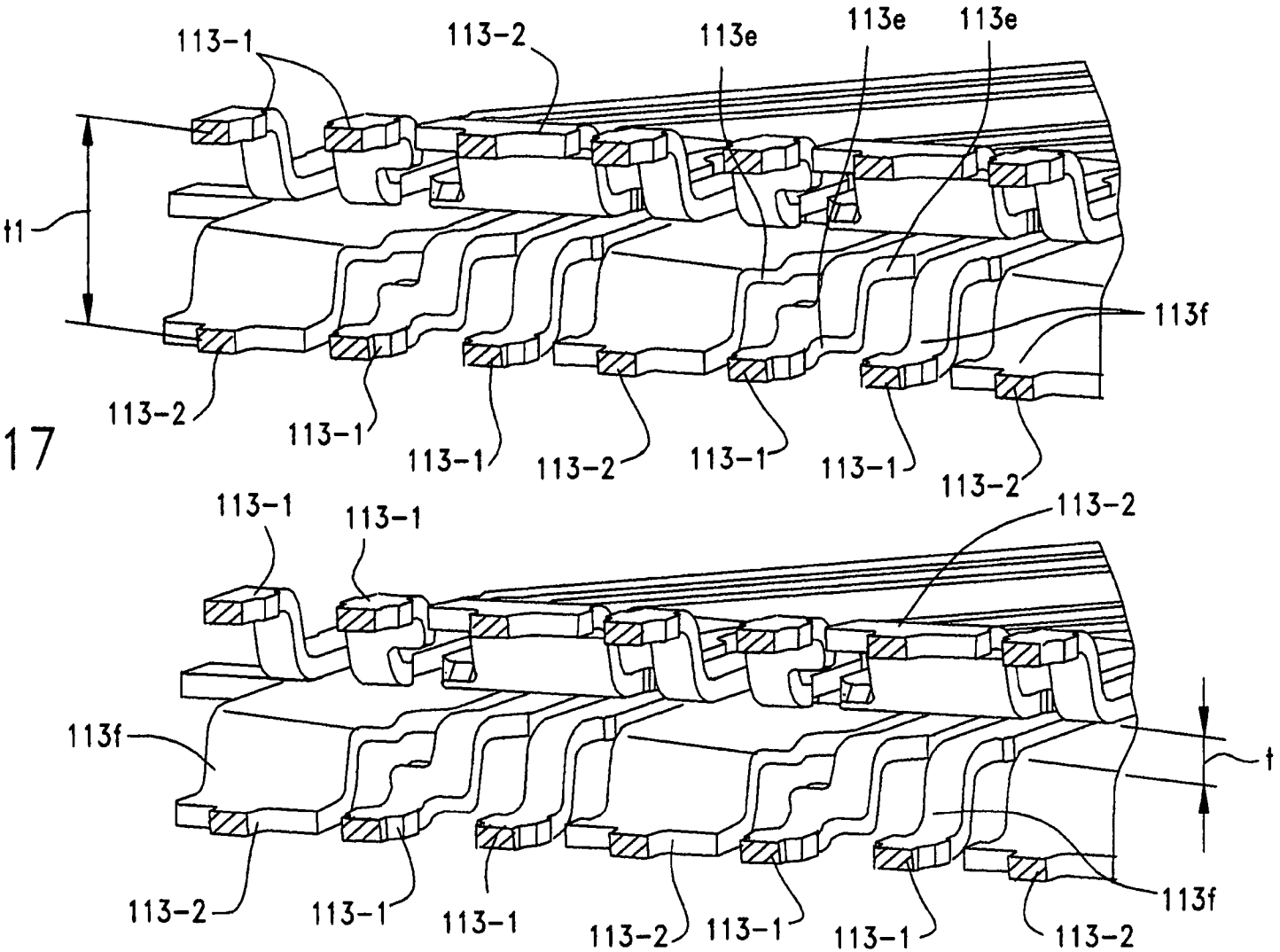
FIG. 17 is the same view as FIG. 15 but with the connector unit support frame removed for clarity; and, FIG. 18 is an enlarged detail view of the area where the terminal body portions meet the tail portions of the connectors of the invention.
Figure 18:
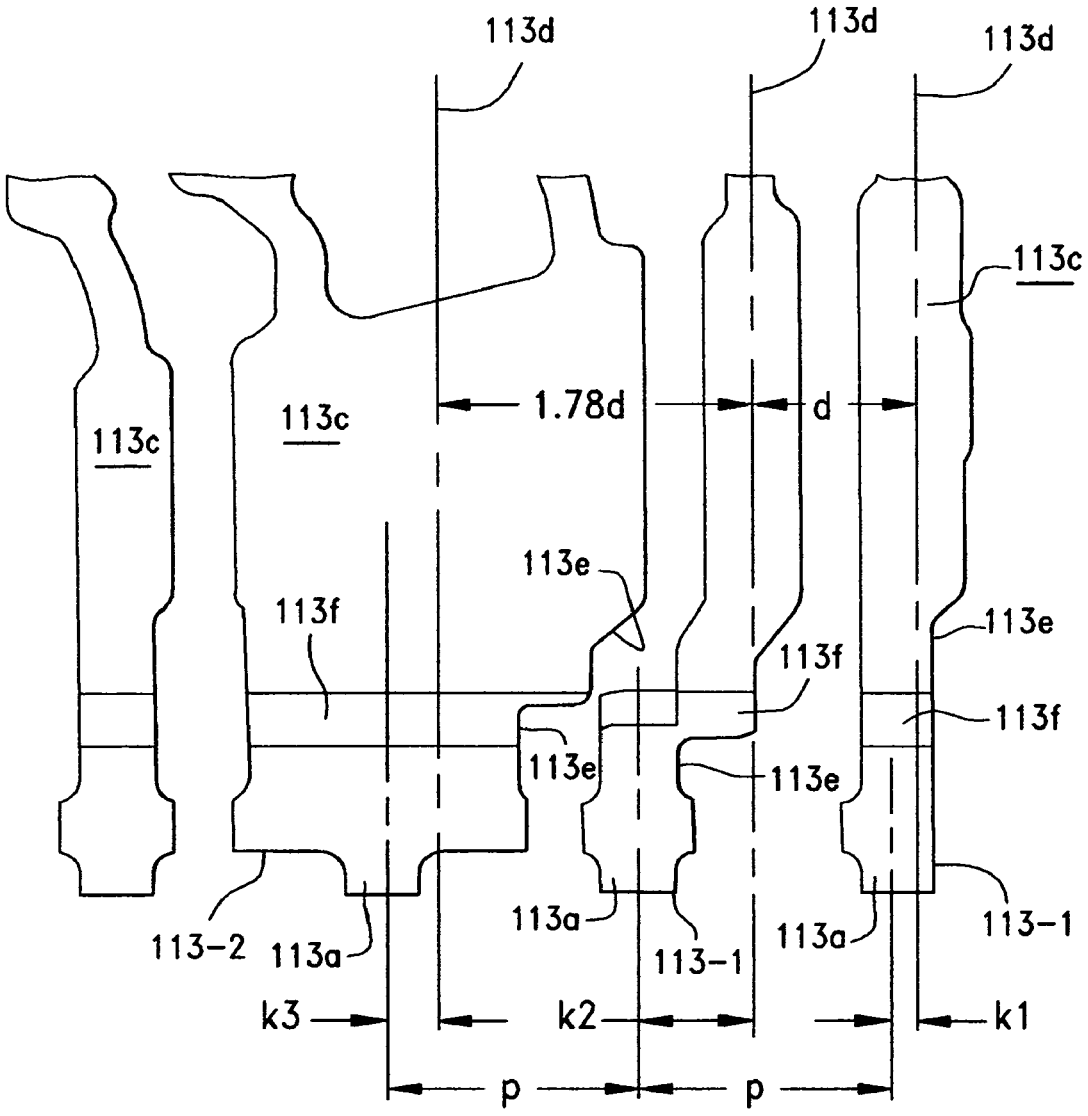

The window 170 is formed within the edges of the ground shield terminal 113-2 and the terminal extent is continued through the window area by two sidebars 174, which are also necked down as seen best in FIG. 13. Preferably, the window 170 exhibits an aspect ratio (height/width) of 1.2. The necking between the ground shield terminals 113-2 and the adjacent differential signal terminal 113-1 is defined by two opposing recesses that are formed in the edges of the signal and ground shield terminals 113-1, 113-2. As shown in the section view of FIG. 13, recesses 175 are formed in the opposing edges of the ground shield terminal 113-2 in the area of the window 170 and may slightly extend past the side edges 170*a* of the windows 170. Other recesses 176 are formed in the edges of the signal terminals 113-1 so that the width of the signal terminals 113-1 reduces down from their normal body portion widths, SW to a reduced width at the windows, RSW. The width of the necked opening NW (FIG. 12) between the two terminals of the differential signal pair is preferably equal to or greater than the signal terminal width SW and preferably the necked width is no more than about 10% greater than the signal terminal width.

This structural change is effected so as to minimize any impedance discontinuity that may occur because of the sudden change in dielectric, (from air to plastic). The signal terminals 113-1 are narrowed while a rectangular window 170 is cut through the ground shield terminals 113-2. These changes increase the edge coupling physical distance and reduce the broadside coupling influence in order to compensate for the change in dielectric from air to plastic. In the area of the window, a portion of the metal of the large ground shield terminal is being replaced by the plastic dielectric in the window area and in this area, the widths of the signal terminals 113-1 are reduced to move their edges farther apart so as to discourage broadside coupling to the ground shield terminal and drive edge coupling between the differential signal terminals 113-1. This increase in edge spacing of the signal terminals 113-1 along the path of the open window 170 leads the differential signal terminal pair to perform electrically as if they are spaced the same distance apart as in their regular width portions. The spacing between the two narrowed signal terminals is filed with plastic which has a high dielectric constant than does air. The plastic filler would tend to increase the coupling between the signal terminal pair at the regular signal terminal pair edge spacing, but by moving them farther apart in this area, electrically, the signal terminal pair will think they are the same distance apart as in the regular area, thereby maintaining coupling between them at the same level and minimizing any impedance discontinuity at the mounting areas While the preferred embodiment of the invention have been shown and described, it will be apparent to those skilled in the art that changes and modifications may be made therein without departing from the spirit of the invention, the scope of which is defined by the appended claims.

We claim:

1. A connector comprising:

a plurality of connector units held within a housing, each connector unit including an insulative support frame supporting a plurality of conductive terminals in two, spaced-apart columns of terminals, the support frame including a first and second frame half, one column of said two terminal columns being supported by the first frame half and the other column of said two terminal columns being supported by the second frame half, each frame half including a first and second spoke members extending radially from a front corner of said frame and a primary spoke member extending radially from the frame front corner to a rear corner of said frame, the first and second frame half spacing said two terminal columns apart from each other, widthwise, within each of said connector units;

each of said terminals including tail portions for mounting to a circuit board, contact portions for mating with an opposing connector and body portions interconnecting the terminal tail and contact portions together, the terminals including distinct pairs of signal terminals and single ground shield terminals, each pair of said signal terminals being aligned edge-to-edge to form differential signal terminal pairs within their respective terminal body portions within each of said two columns, each of said differential signal terminal pairs being separated from another differential signal terminal pair within a terminal column by a single one of said ground shield terminals, said ground shield terminals being alternatingly spaced apart as between said two terminal columns such that said ground shield terminals in each of said terminal columns are spaced apart from and face a differential signal terminal pair of an opposing terminal column, each of said ground shield terminals being wider than the differential signal terminal pair within said connector unit; and, wherein said terminals are attached to said first and second frame halves along said spoke members, wherein said spoke members on both the first and second frame half extend across outer surfaces of said terminals and said spoke members on said first frame half includes interior spoke portions that extend across inner surfaces of said terminals of said first frame half, said interior spoke portions spacing said terminal columns apart from each other, wherein said primary spoke members bisect said frame first and second halves and said first and second frame halves further include a pair of secondary spoke members disposed therein between said primary spoke member and each of said first and second spoke members, wherein said interior spoke portions of said first and second spoke member and said primary spoke member define two V-shaped air channels on an inner face of said first frame half.

2. The connector of claim 1, wherein said primary spoke members bisect said first and second frame halves.

3. The connector of claim 1, wherein said first frame half includes slots that communicate with said V-shaped air channels.

4. The connector of claim 1, wherein said primary and secondary spoke members are interconnected at one end thereof by an additional spoke member.

5. The connector of claim 4, wherein the additional spoke member extends at an angle between two adjacent sides of said support frames.

6. The connector of claim 1, wherein said spoke member extend linearly within said frame.

7. A connector, comprising:

a plurality of individual connector units, each connector unit supporting a plurality of conductive terminals in two spaced-apart linear arrays of terminals, each of said connector units including a dielectric frame formed from first and second halves, each frame half including at least four distinct sides, two of the four sides being adjacent each other, one of the two sides supporting terminal tail portions of the terminals and the other of said two sides supporting terminal contact portions of said terminals, each of said linear terminal arrays including a plurality of pairs of differential signal terminals arranged edge-to-edge within said arrays, and said pairs being separated by intervening ground shield terminals, the ground shield and signal terminals in said two terminal arrays such that each of said ground shield terminals in one of said two linear arrays face a differential signal terminal pair in the opposing linear array;

each frame half including intersecting vertical and horizontal spoke members and at least one primary spoke member that extends out from the intersection of the vertical and horizontal spoke members to divide the area between the vertical and horizontal members into two parts, each frame half further including secondary support members interposed between said primary and vertical and horizontal spoke members to define a network of load transferring support members that transfer press-in loading forces throughout said connector when said connector is mounted on a circuit board, wherein said vertical, horizontal and at least one primary spoke members include interior portions that extend along the inner surface of said second frame half, and the interior portions serve as stand-offs to space said two linear terminal arrays apart.

8. The connector of claim 7, wherein said spoke members extend along only the outer surfaces of said first linear array of terminals as part of said first frame half and said spoke members extend along both of the outer and inner surfaces of said second frame half.

9. The connector of claim 7, wherein said spoke members extend radially within each of said first and second frame halves.

* * * * *